US009146509B2

(12) United States Patent
Sato

(10) Patent No.: US 9,146,509 B2
(45) Date of Patent: Sep. 29, 2015

(54) IMAGE FORMING APPARATUS WITH ROTATIONAL SPEED CONTROL UNIT FOR FIXING MEMBER

(75) Inventor: Toshiki Sato, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 337 days.

(21) Appl. No.: 13/298,638

(22) Filed: Nov. 17, 2011

(65) Prior Publication Data

US 2012/0148280 A1 Jun. 14, 2012

(30) Foreign Application Priority Data

Dec. 14, 2010 (JP) ..... 2010-278388

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/67–70; 219/216
See application file for complete search history.

(56) References Cited

U.S. PATENT DOCUMENTS

| | | | | |
|---|---|---|---|---|
| 4,385,826 | A * | 5/1983 | Itoh | 399/70 |
| 5,555,075 | A * | 9/1996 | Fukano et al. | 399/69 |
| 2003/0081962 | A1 * | 5/2003 | Murata | 399/69 |
| 2003/0091360 | A1 * | 5/2003 | Onodera et al. | 399/69 |
| 2004/0131374 | A1 * | 7/2004 | Sakai | 399/68 |
| 2006/0221362 | A1 * | 10/2006 | Julien | |
| 2010/0104307 | A1 * | 4/2010 | Shinyama | 399/68 |

FOREIGN PATENT DOCUMENTS

| | | | |
|---|---|---|---|
| JP | 7-121053 | A | 5/1995 |
| JP | 2003-316199 | A | 11/2003 |
| JP | 2004-205988 | A | 7/2004 |
| JP | 2007-33618 | A | 2/2007 |
| JP | 2007033618 | A * | 2/2007 |
| JP | 2009-301028 | A | 12/2009 |
| JP | 2009301028 | A * | 12/2009 |

* cited by examiner

*Primary Examiner* — Walter L Lindsay, Jr.
*Assistant Examiner* — Milton Gonzalez
(74) *Attorney, Agent, or Firm* — Kubotera & Associates, LLC

(57) ABSTRACT

An image forming apparatus includes a fixing member; a pressing member; a first temperature detection unit for detecting a temperature of the fixing member; a second temperature detection unit for detecting a temperature of the pressing member; and a rotational speed control unit for controlling a rotational speed of the fixing member according to the temperature detected with the first temperature detection unit and the temperature detected with the second temperature detection unit.

14 Claims, 14 Drawing Sheets

IMAGE FORMING APPARATUS WITH ROTATIONAL SPEED CONTROL UNIT FOR FIXING MEMBER

BACKGROUND OF THE INVENTION AND RELATED ART STATEMENT

The present invention relates to an image forming apparatus including a fixing device for fixing a transferred toner image to a sheet with pressure and heat.

In a conventional image forming apparatus, a transfer portion is provided for transferring a toner image corresponding to a print image to a sheet, and a fixing device is provided for fixing the toner image to the sheet with pressure and head of a fixing roller and a pressing roller thereof. When the sheet is not transported, a rotational speed of each of the fixing roller and the pressing roller is adjusted. Accordingly, a temperature difference between the fixing roller and the pressing roller is decreased. Accordingly, it is possible to prevent the sheet passing through the fixing device from being curled (refer to Patent Reference).

Patent Reference Japanese Patent Publication No. 2003-316199

In the conventional image forming apparatus disclosed in Patent Reference, it is still difficult to properly fix the toner image to the sheet, thereby deteriorating image quality.

In view of the problems described above, an object of the present invention is to provide an image forming apparatus capable of forming an image with high quality.

Further objects and advantages of the invention will be apparent from the following description of the invention.

SUMMARY OF THE INVENTION

In order to attain the objects described above, according to an aspect of the present invention, an image forming apparatus includes a fixing member; a pressing member; a first temperature detection unit for detecting a temperature of the fixing member; a second temperature detection unit for detecting a temperature of the pressing member; and a rotational speed control unit for controlling a rotational speed of the fixing member according to the temperature detected with the first temperature detection unit and the temperature detected with the second temperature detection unit.

According to the aspect of the present invention, it is possible to form an image with high quality.

BRIEF DESCRIPTION OF THE DRAWINGS

FIG. 4(*b*) is a schematic sectional view of the fixing roller and the pressing roller of the fixing device taken along a line A-A' in FIG. 4(*a*), and FIG. 4(*c*) is a schematic sectional view of the fixing roller and the pressing roller of the fixing device taken along a line B-B' in FIG. 4(*a*);

FIG. 15(*b*) is a graph showing a relationship between a rotational speed of a fixing roller of the fixing device and a temperature of the pressing roller of the fixing device of the image forming apparatus according to the second embodiment of the present invention.

DETAILED DESCRIPTION OF PREFERRED EMBODIMENTS

Hereunder, embodiments of the present invention will be explained with reference to the accompanying drawings.

First Embodiment

Figure 2:
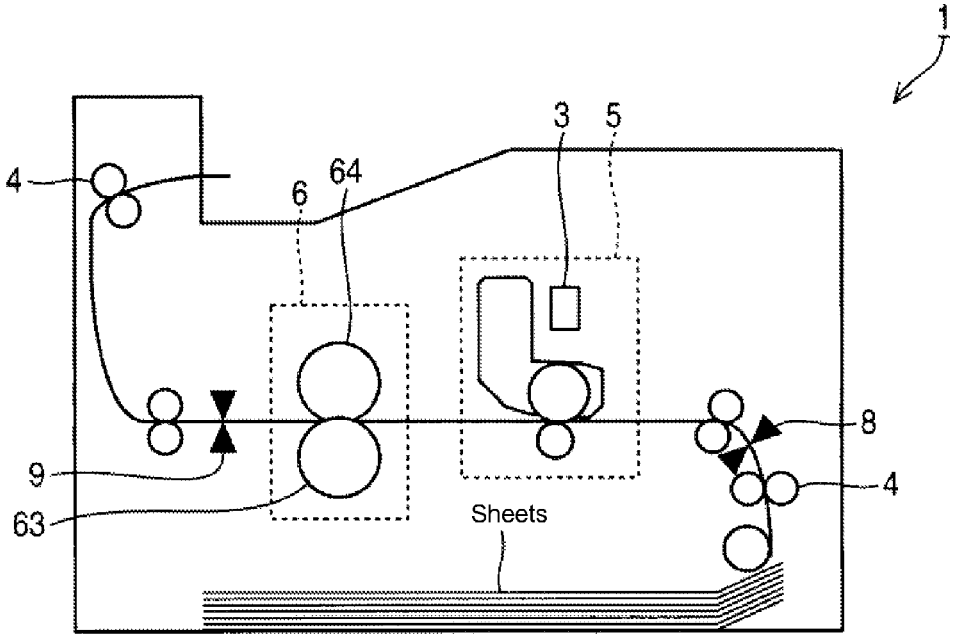
FIG. 2 is a schematic sectional view showing a configuration of the image forming apparatus according to the first embodiment of the present invention.

A first embodiment of the present invention will be explained. FIG. 2 is a schematic sectional view showing a configuration of an image forming apparatus 1 according to the first embodiment of the present invention.

As shown in FIG. 2, the image forming apparatus 1 includes a sheet transportation portion 4 (a medium transportation portion) for separating and transporting a sheet (a print medium) stored in a sheet tray one by one; an LED (Light Emitting Diode) head 3 as a recording light exposure unit; a toner image forming portion 5 for forming a toner image according to recording light; and a fixing device 6 for fixing the toner image to the sheet. The image forming apparatus 1 may be a printer of an electro-photography type and the like.

In the embodiment, the sheet transportation portion 4 forms a sheet transportation path, and the image forming apparatus 1 further includes a writing sensor 8 and a discharge sensor 9 disposed on the sheet transportation path for detecting a position of the sheet thus transported. More specifically, from an upstream side of the sheet transportation path in a sheet transportation direction, the writing sensor 8, the toner image forming portion 5, the fixing device 6 formed of a heating roller or a fixing roller 64 and a pressing roller 63, and the discharge sensor 9 are arranged. Further, the LED head 3 is arranged adjacent to the toner image forming portion 5.

In the embodiment, when a print control unit 100 (not shown in FIG. 2) of the image forming apparatus 1 receives a print instruction from a host computer and the like as an upper device, the sheet transportation portion 4 transports the sheet one by one to the toner image forming portion 5 according to a timing of an image forming operation. Then, the LED head 3 irradiates recording light on the toner image forming portion 5 according to print information of the print instruction thus received, so that the toner image forming portion 5 forms the toner image on the sheet thus transported according to recording light thus irradiated.

After the toner image is formed on the sheet, the sheet transportation portion 4 transports the sheet to the fixing device 6, so that the toner image on the sheet is fixed to the sheet with heat and pressure of the pressing roller 63 and the fixing roller 64. After the toner image is fixed to the sheet, the sheet transportation portion 4 discharges the sheet outside the image forming apparatus 1.

Figure 1:
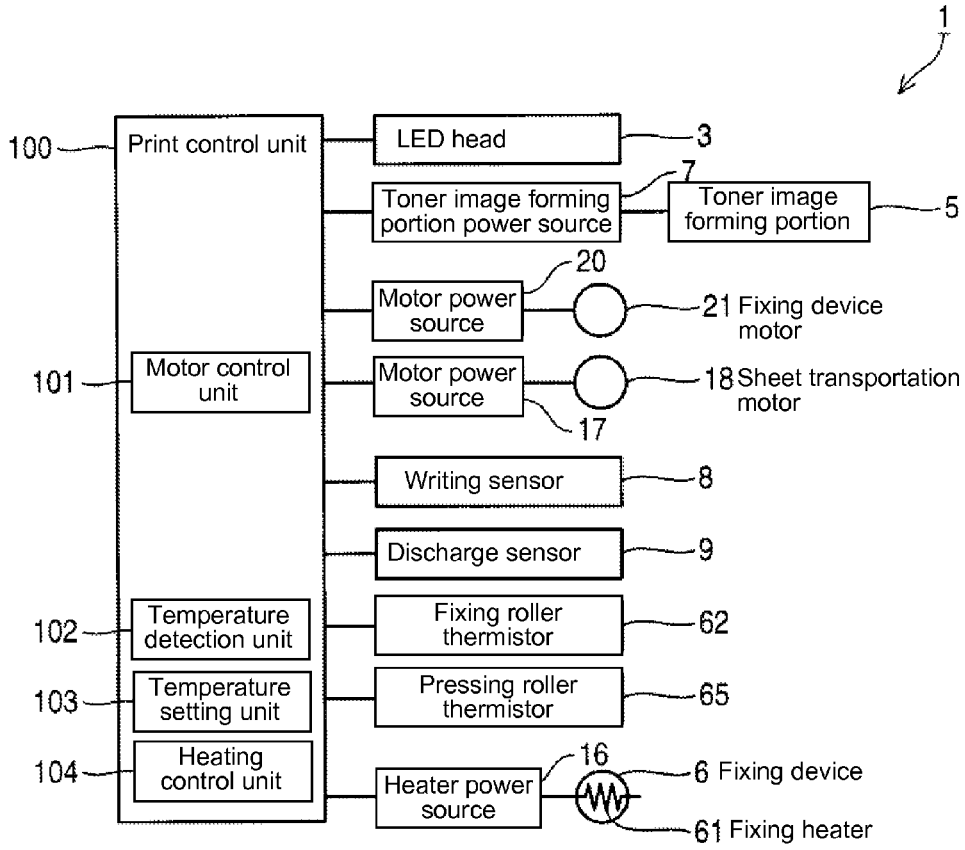
FIG. 1 is a block diagram showing a configuration of a control system of an image forming apparatus according to a first embodiment of the present invention.

FIG. 1 is a block diagram showing a configuration of a control system of the image forming apparatus 1 according to the first embodiment of the present invention.

As shown in FIG. 1, the image forming apparatus 1 includes the print control unit 100 for controlling the printing operation of the image forming apparatus 1; the LED head 3 as the recording light exposure unit; the toner image forming portion 5 for forming the toner image according to recording light; a toner image forming portion power source 7 for applying a voltage to the toner image forming portion 5; a sheet transportation motor 18 for rotating various rollers that transport the sheet; a motor power source 17 for supplying electric power to the sheet transportation motor 18; a fixing device motor 21 for rotating the pressing roller 63 and the fixing roller 64 of the fixing device 6; and a motor power source 20 for supplying electric power to the fixing device motor 21.

Further, the image forming apparatus 1 includes the writing sensor 8 and the discharge sensor 9 for detecting the position of the sheet thus transported; the fixing device 6 having a fixing heater 61 that heats the fixing roller 64 (refer to FIG. 2); a heater power source 16 for supplying electric power to the fixing heater 61; a fixing roller thermistor 62 for detecting a temperature of the fixing roller 64 as a fixing member of the fixing device 6 (refer to FIG. 2); and a pressing roller thermistor 65 for detecting a temperature of the pressing roller 63 as a pressing member of the fixing device 6 (refer to FIG. 2).

In the embodiment, the print control unit 100 is formed of a CPU (Center Processing Unit) as a calculation unit or a control unit and a memory and the like as a storage unit. The print control unit 100 includes a motor control unit 101; a temperature determining unit 102; a temperature setting unit 103; and a heating control unit 104, so that the print control unit 100 controls the printing operation of the image forming apparatus 1. Further, the print control unit 100 includes a timing unit such as a timer and the like for measuring an elapsed time.

In the embodiment, the motor control unit 101 as a rotational speed control unit is provided for controlling electric power supplied from the motor power source 17, so that the motor control unit 101 controls an operation of the sheet transportation motor 18. Further, the motor control unit 101 is provided for controlling electric power supplied from the motor power source 20, so that the motor control unit 101 controls an operation of the fixing device motor 21. The sheet transportation motor 18 is connected to various rollers of the sheet transportation portion 4 (refer to FIG. 2), and the fixing device motor 21 is connected to the fixing roller 64 (refer to FIG. 2). The motor control unit 101 is configured to control rotational speeds of the rollers of the sheet transportation portion 4 including a sheet supply roller and the fixing roller 64. It is noted that the rotational speed is defined as a circumferential speed.

In the embodiment, the temperature determining unit 102 is configured to determine a surface temperature of the fixing roller 64 through the fixing roller thermistor 62 and a surface temperature of the pressing roller 63 through the pressing roller thermistor 65. The temperature setting unit 103 as a temperature setting portion is provided for selecting and setting an optimal temperature or a set temperature for the fixing device 6 according to an operational condition of the image forming apparatus 1.

In the embodiment, the heating control unit 104 as a heating control portion is provided for controlling the heater power source 16 according to a temperature determination result of the temperature determining unit 102, so that the heater power source 16 heats the fixing device 6 at the set temperature selected with the temperature setting unit 103. Accordingly, the heating control unit 104 is configured to control the heater power source 16, thereby performing a temperature control of the fixing roller 64 of the fixing device 6.

In the embodiment, the print control unit 100 is connected to the LED head 3, the toner image forming portion power source 7, the motor power source 17, the motor power source 20, the writing sensor 8, the discharge sensor 9, the fixing roller thermistor 62, the pressing roller thermistor 65, and the heater power source 16. Further, the toner image forming portion power source 7 is connected to the toner image forming portion 5, and the motor power source 17 is connected to the sheet transportation motor 18. Further, the motor power source 20 is connected to the fixing device motor 21, and the heater power source 16 is connected to the fixing heater 61.

Figure 3:
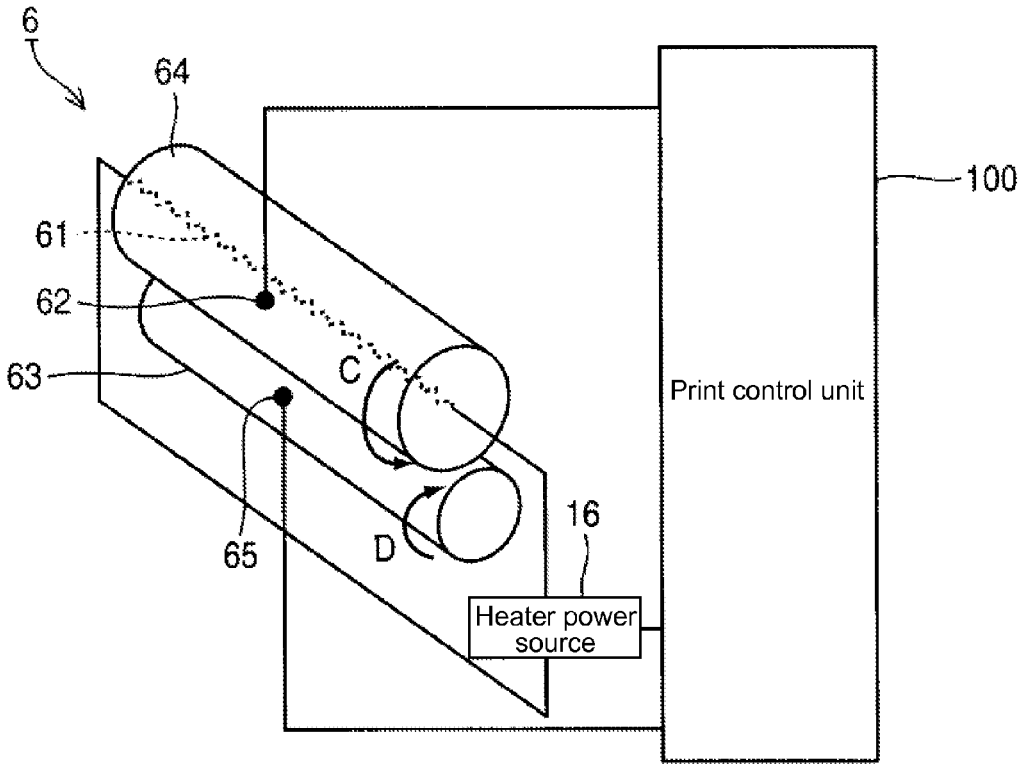
FIG. 3 is a schematic perspective view showing a configuration of a fixing device of the image forming apparatus according to the first embodiment of the present invention.

FIG. 3 is a schematic perspective view showing a configuration of the fixing device 6 of the image forming apparatus 1 according to the first embodiment of the present invention.

As shown in FIG. 3, the fixing device 6 includes the fixing roller 64 as the fixing member for supplying heat to the sheet and transporting the sheet; a fixing heater 61 as a heating member for supplying heat to the fixing roller 64; the pressing roller 63 arranged to contact with an outer circumferential surface of the fixing roller 64 for applying pressure to the sheet; the fixing roller thermistor 62 as a first temperature detection unit for detecting a surface temperature of the fixing roller 64; and the pressing roller thermistor 65 as a second temperature detection unit for detecting a surface temperature of the pressing roller 63.

In the embodiment, the fixing roller 64 is arranged to rotate in an arrow direction C, and the pressing roller 63 is arranged to rotate in an arrow direction D. Further, the pressing roller 63 and the fixing roller 64 are arranged to sandwich and transport the sheet, so that the toner image transferred to the sheet is fixed to the sheet through heat and pressure.

A configuration of the pressing roller 63 and the fixing roller 64 of the fixing device 6 will be explained in more detail next with reference to FIGS. 4(*a*) to 4(*c*).

Figure 4A:
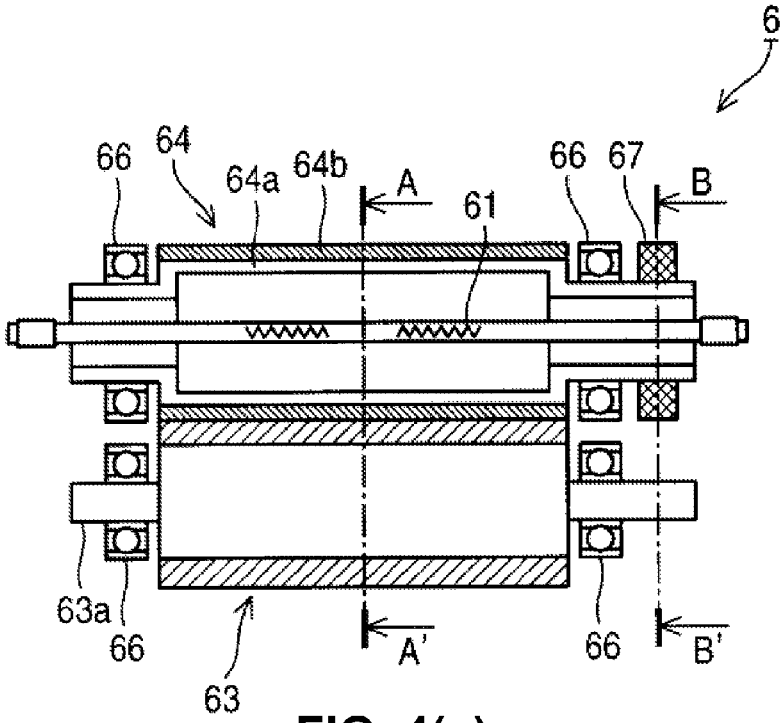
FIGS. 4(*a*) to 4(*c*) are schematic views showing the configuration of the fixing device of the image forming apparatus according to the first embodiment of the present invention, wherein FIG. 4(*a*) is a schematic sectional view of a fixing roller and a pressing roller of the fixing device.
Figure 4B:
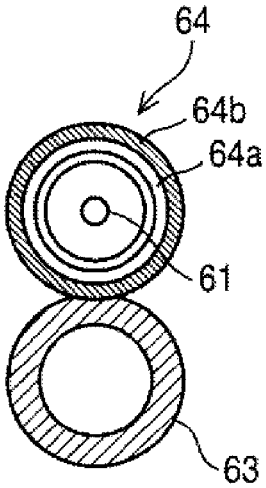
Figure 4C:
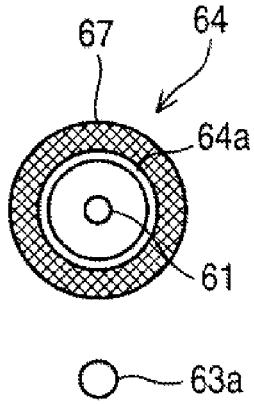

FIGS. 4(*a*) to 4(*c*) are schematic views showing the configuration of the fixing device 6 of the image forming apparatus 1 according to the first embodiment of the present invention, More specifically, FIG. 4(*a*) is a schematic sectional view of the fixing roller 64 and the pressing roller 63 of the fixing device 6; FIG. 4(*b*) is a schematic sectional view of the fixing roller 64 and the pressing roller 63 of the fixing device 6 taken along a line A-A' in FIG. 4(*a*), and FIG. 4(*c*) is a schematic sectional view of the fixing roller 64 and the pressing roller 63 of the fixing device 6 taken along a line B-B' in FIG. 4(*a*), FIG. 4(*b*) is a schematic sectional view at a center portion of the fixing device 6 in a longitudinal direction thereof, and FIG. 4(*b*) is a schematic sectional view at an end portion of the fixing device 6 in a longitudinal direction thereof.

As shown in FIG. 4(*a*), the fixing device 6 includes ball bearings 66 as a rotational supporting member for supporting the fixing roller 64 and the pressing roller 63 to be rotatable, and a gear 67 as a drive force transmitting member for transmitting a drive force of the fixing device motor 21 (not shown in FIG. 4(*a*)) to the fixing roller 64. Further, the fixing roller 64 is arranged such that the outer circumferential surface thereof contacts with the outer circumferential surface of the pressing roller 63. The fixing heater 61 is disposed inside a hollow structure of the fixing roller 64 such that the fixing heater 61 does not contact with an inner surface of the pressing roller 63.

In the embodiment, the fixing roller thermistor 62 (not shown in FIG. 4(*a*)) is arranged to contact with the outer circumferential surface of the fixing roller 64, and the pressing roller thermistor 65 (not shown in FIG. 4(*a*)) is arranged to contact with the outer circumferential surface of the pressing roller 63. The fixing heater 61 may be arranged such that the fixing heater 61 does not contact with the inner surface of the pressing roller 63. Further, the fixing roller thermistor 62 and the pressing roller thermistor 65 (not shown in FIG. 4(*a*)) may be arranged so as not to contact with the outer circumferential surfaces of the fixing roller 64 and the pressing roller 63, respectively.

In the embodiment, the ball bearings 66 are disposed on both end portions of a rotational shaft of each of the fixing roller 64 and the pressing roller 63, so that the ball bearings 66 support the fixing roller 64 and the pressing roller 63 to be rotatable. The gear 67 is disposed on one end portion of the rotational shaft of the fixing roller 64 for transmitting the drive force of the fixing device motor 21 (not shown in FIG. 4(*a*)) to the fixing roller 64.

As shown in FIG. 4(*b*), the fixing roller 64 includes a core metal 64*a* as a base member formed of a steel pipe with an outer diameter of, for example, 30 mm, and an elastic layer 64*b* covering the core metal 64*a*. The elastic layer 64*b* is formed of a silicone rubber, and has a thickness of 1 mm. The core metal 64*a* is supported on a supporting member through the ball bearings 66 at both end portions thereof to be rotatable. Further, the gear 67 is disposed on one end portion of the core metal 64*a*. When the fixing device motor (not shown in FIG. 4(*a*)) drives the gear 67 to rotate, the fixing roller 64 is driven to rotate.

In the embodiment, the pressing roller 63 is urged toward the fixing roller 64 with an elastic member such as a spring (not shown). Accordingly, an abut region (a nip portion) is formed between the pressing roller 63 and the fixing roller 64. A rotational shaft 63*a* of the pressing roller 63 is supported on a supporting member through the ball bearings 66 at both end portions thereof to be rotatable.

In the embodiment, the fixing roller thermistor 62 and the pressing roller thermistor 65 (refer to FIG. 3) are formed of an element having a variable resistivity depending on a temperature. Accordingly, when the temperature determining unit 102 of the print control unit 100 (refer to FIG. 1) determines a resistivity of the fixing roller thermistor 62 or the pressing roller thermistor 65, it is possible to determine a temperature of the fixing roller thermistor 62 or the pressing roller thermistor 65.

As described above, the fixing roller thermistor 62 is arranged to contact with the outer circumferential surface of the fixing roller 64, and the pressing roller thermistor 65 is arranged to contact with the outer circumferential surface of the pressing roller 63. Accordingly, the temperature determining unit 102 of the print control unit 100 (refer to FIG. 1) is capable of determining the temperatures of the fixing roller thermistor 62 and the pressing roller thermistor 65. In the embodiment, the fixing roller thermistor 62 and the pressing roller thermistor 65 are formed of the elements having a resistivity decreasing as the temperatures thereof rise.

In the embodiment, the fixing heater 61 is formed of a heating member such as a halogen heater, so that the heating member heats according to electric power supplied from commercial electric power source. A voltage of, for example, 100 V is supplied to the fixing heater 61, and the fixing heater 61 has an output of, for example, 800 W.

An operation of the image forming apparatus 1 will be explained with reference to FIGS. 1 to 3. When the print control unit 100 receives the print instruction from the upper device and the like, the motor control unit 101 controls the fixing device motor 21 to rotate the fixing roller 64 through the gear 67. Then, the print control unit 100 determines whether the temperature detected with the fixing roller thermistor 62 of the fixing device 6 is within a printable temperature range specified in advance. When the print control unit 100 determines that the temperature is within the printable temperature range, the transportation of the sheet starts.

In the embodiment, the printable temperature range is defined as a range between a lower limit temperature T1 and an upper limit temperature T2 of the fixing roller 64 within which the toner image can be fixed to the sheet. The lower limit temperature T1 may be, for example, 175° C., and the upper limit temperature T2 may be, for example, 205° C.

When the temperature detected with the fixing roller thermistor 62 exceeds the upper limit temperature T2, the heating control unit 104 stops the electric power supply from the heater power source 16 to the fixing heater 61, so that cool down is performed to lower the temperature of the fixing roller 64.

On the other hand, when the temperature detected with the fixing roller thermistor 62 is below the lower limit temperature T1, the heating control unit 104 starts the electric power supply from the heater power source 16 to the fixing heater 61, so that warm up is performed to raise the temperature of the fixing roller 64. After the cool down or the warm up is performed, when the print control unit 100 determines that the temperature is within the printable temperature range specified in advance, the transportation of the sheet starts.

In the next step, the print control unit 100 supplies electric power to the sheet transportation motor 18 from the motor power source 17 at the image forming timing, so that the sheet transportation portion 4 starts transporting the sheet. At the same time, the print control unit 100 supplies electric power to the fixing device motor 21 from the motor power source 20, so that the fixing roller 64 of the fixing device 6 starts rotating. Accordingly, the sheet is transported to the toner image forming portion 5. The LED head 3 irradiate recording light on the toner image forming portion 5 according to the print information of the print instruction, so that the toner image forming portion 5 forms the toner image on the sheet according to recording light.

In the next step, after the sheet transportation portion 4 transports the sheet to the fixing device 6, the toner image is fixed to the sheet through heat and pressure of the fixing device 6. After the toner image is fixed to the sheet, the sheet is discharged outside the image forming apparatus 1.

As described above, the operation corresponds to the print instruction for printing one sheet. When a plurality of sheets is printed sequentially, after the first sheet is supplied, a sensor monitors the transportation position of the sheet all the time. Accordingly, the transportation of the second sheet starts with a specific distance (an interval) from a trailing edge of the first sheet. When the next sheet is supplied with the specific distance from the trailing edge of the previous sheet, a plurality of sheets is supplied while the constant between-sheets distance (referred to as a between-sheets distance) is maintained.

As the sheet does not exist in the between-sheets distance, the printing operation or the image forming process is not performed. Accordingly, when the between-sheets distance is shorter, it is possible to print a larger number of the sheets, thereby increasing through-put and productivity (the number of sheets printable within a specific period of time). However, the between-sheets distance is limited to a specific distance, for example, 60 mm, due to constraint of accuracy of the sheet transportation or dimensional accuracy of the image forming process.

As described above, in the embodiment, the print control unit 100 controls the temperature of the fixing roller 64 as the fixing member within the printable temperature range. Accordingly, it is possible to properly apply heat to the sheet, thereby preventing image quality from deteriorating.

Figure 5:
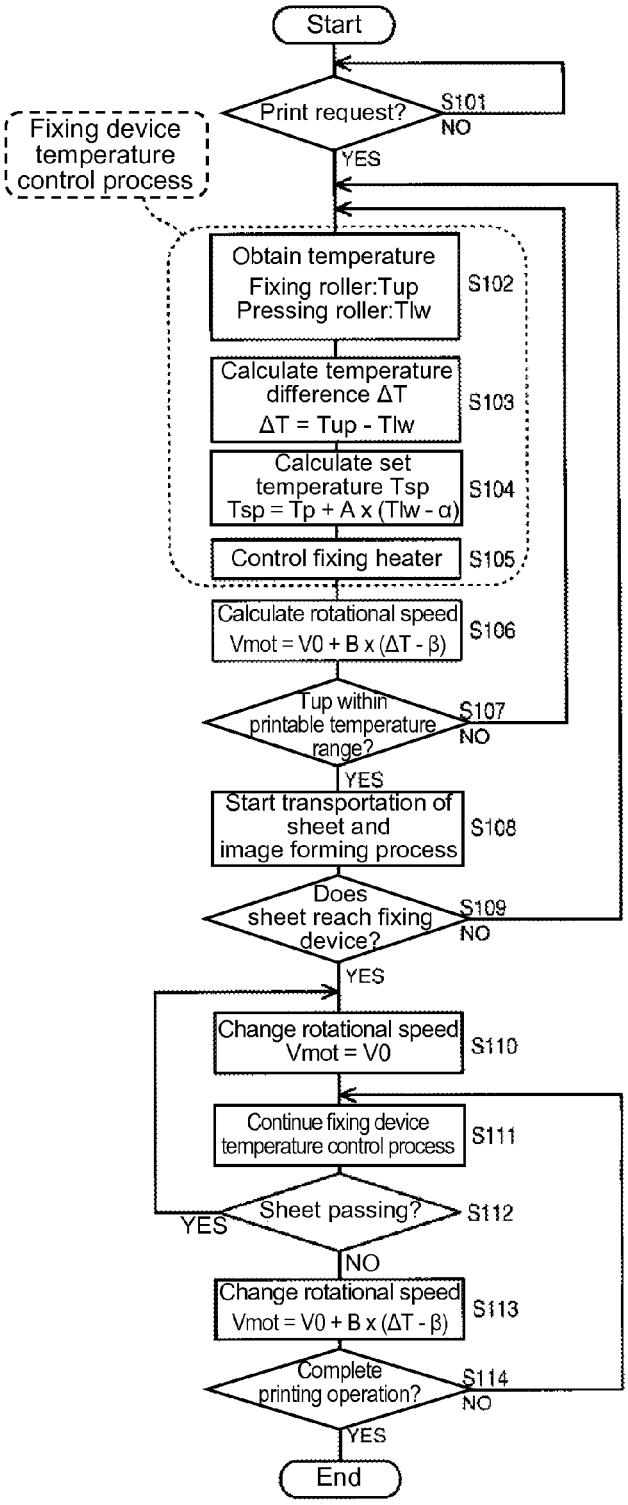
FIG. 5 is a flow chart showing an operation of the image forming apparatus according to the first embodiment of the present invention.

The operation of the image forming apparatus 1 will be explained with reference to the flow chart shown in FIG. 5 as well as FIGS. 1, 2, and 3. FIG. 5 is the flow chart showing the operation of the image forming apparatus 1 according to the first embodiment of the present invention.

In step S101, the print control unit 100 waits for a print request as the print instruction from the upper device and the like to determine whether the print control unit 100 receives the print request. When the print control unit 100 determines that the print control unit 100 receives the print request, the process proceeds to step S102, so that the printing operation starts.

In step S102, when the print control unit 100 determines that the print control unit 100 receives the print request, the print control unit 100 confirms whether the fixing device 6 is in the printable state. More specifically, the print control unit 100 obtains the temperature Tup of the fixing roller 64 and the temperature Tlw of the pressing roller 63 with the temperature determining unit 102.

In step S103, after the print control unit 100 obtains the temperature Tup of the fixing roller 64 and the temperature Tlw of the pressing roller 63, the print control unit 100 calculates a temperature difference ΔT (referred to as an inter-roller temperature difference) between the fixing roller 64 and the pressing roller 63 in the current state from the temperature Tup of the fixing roller 64 and the temperature Tlw of the pressing roller 63 (ΔT=Tup−Tlw).

In step S104, the temperature setting unit 103 calculates the set temperature Tsp of the fixing roller 64 from the following equation:

$$Tsp=Tp+A\times(Tlw-\alpha)$$

wherein Tp (° C.) is the temperature of the fixing roller 64 when the toner image can be properly fixed at the temperature α (° C.) of the pressing roller 63. The temperature α (° C.) of the pressing roller 63 is a specific temperature, and A is a coefficient for calculating an optimal set temperature.

In the embodiment, the temperature Tp (° C.), the temperature α (° C.), and the coefficient A may be obtained from an experiment. For example, the temperature Tp may be 170° C., the temperature α may be 120° C., and the coefficient. A may be 0.25. In this case, when the temperature Tlw of the pressing roller 63 is 140° C., the set temperature Tsp of the fixing roller 64 is given to be 175° C. (170+0.25×(140−120)=175).

Figure 6:
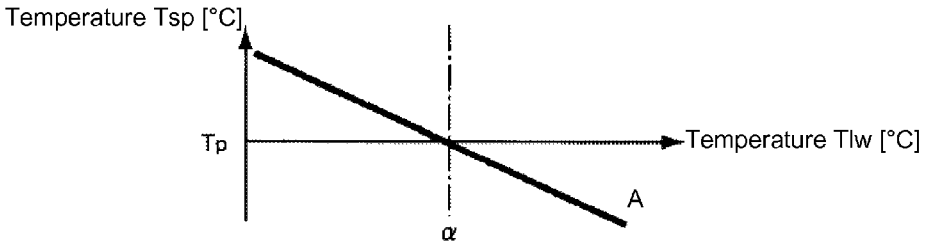
FIG. 6 is a graph showing a relationship between a temperature of the pressing roller and a set temperature of the fixing roller of the image forming apparatus according to the first embodiment of the present invention.

A relationship between the temperature Tlw of the pressing roller 63 and the set temperature Tsp of the fixing roller 64 will be explained next. FIG. 6 is a graph showing the relationship between the temperature Tlw of the pressing roller 63 and the set temperature Tsp of the fixing roller 64 of the image forming apparatus 1 according to the first embodiment of the present invention.

When the toner images are sequentially fixed to the sheets, the sheets tend to absorb heat from the pressing roller 63, thereby decreasing the temperature Tlw of the pressing roller 63. In order to properly fix the toner image to the sheet, it is necessary to apply a sufficient quantity of heat. Accordingly, when the temperature Tlw of the pressing roller 63 is decreased, the set temperature Tsp of the fixing roller 64 is set high to compensate the temperature decrease.

On the other hand, if it takes long time to process the print request from the upper device and the like, and the fixing roller 64 and the pressing roller 63 keep rotating for a long period of time for waiting the process to be complete, the pressing roller 63 tends to receive an excessive quantity of heat from the fixing roller 64, thereby increasing the temperature Tlw of the pressing roller 63. Accordingly, when the temperature Tlw of the pressing roller 63 is increased, the set temperature Tsp of the fixing roller 64 is set low to reduce heat applied to the sheet. As a whole, as shown in FIG. 6, the set temperature Tsp of the fixing roller 64 is set according to the following equation:

$$Tsp=Tp+A\times(Tlw-\alpha)$$

In step S105, the heating control unit 104 controls the fixing heater 61 such that the temperature of the fixing roller 64 becomes the set temperature Tsp determined with the temperature setting unit 103. It is noted that the process from step S102 to step S105 is referred to as a fixing device temperature control process, which is repeated in the later process.

In step S106, the motor control unit 101 calculates the rotational speed Vmot of the fixing roller 64 according to the temperature difference ΔT between the fixing roller 64 and the pressing roller 63 calculated in step S103 through the following equation:

$$Vmot(mm/s)=V0+B\times(\Delta T-\beta)$$

where V0 (mm/s) is the rotational speed of the fixing roller 64 upon fixing, and β (° C.) is the temperature difference between the fixing roller 64 and the pressing roller 63 when the sheet is prevented from being curled at the rotational speed V0. B is a coefficient representing a relationship between the rotational speed and the temperature difference necessary to change the temperature difference between the fixing roller 64 and the pressing roller 63 from the current temperature difference between the fixing roller 64 and the pressing roller 63 to the temperature difference β when the leading edge of the sheet reaches the fixing roller 64.

In the embodiment, the rotational speed V0, the coefficient B, and the temperature difference β may be obtained from an experiment. For example, the rotational speed V0 may be 140 mm/s, the coefficient B may be 1.2, and the temperature difference β may be 60° C. In this case, when the temperature Tup of the fixing roller 64 is 170° C. and the temperature Tlw of the pressing roller 63 is 80° C., the temperature difference ΔT becomes 90° C. Accordingly, the rotational speed Vmot of the fixing roller 64 is given to be 176 mm/s (140+1.2×(90−60)=176).

Figure 7:
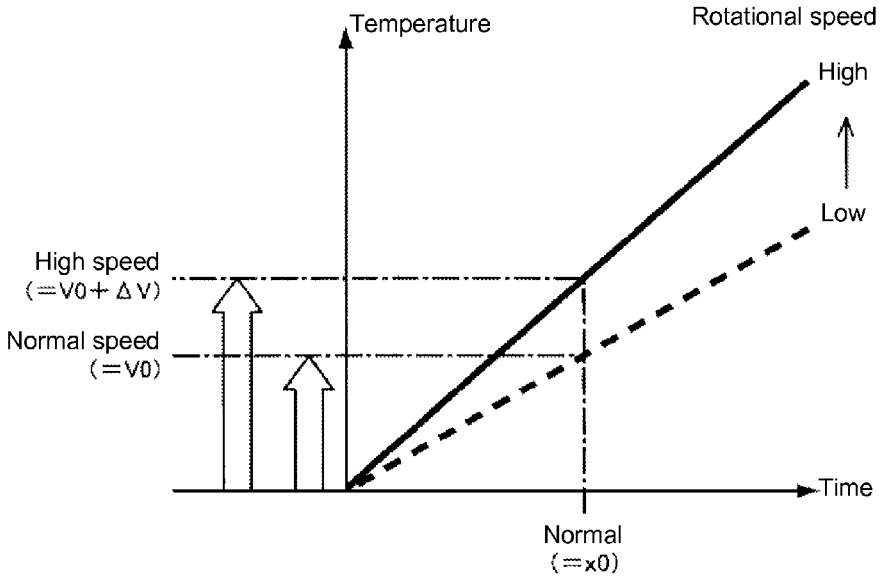
FIG. 7 is a graph showing a time change in the temperature of the pressing roller of the image forming apparatus according to the first embodiment of the present invention.

A relationship between the rotational speed of the fixing roller 64 and the temperature change of the pressing roller 63 will be explained next. FIG. 7 is a graph showing a time change in the temperature of the pressing roller 63 of the image forming apparatus 1 according to the first embodiment of the present invention. In FIG. 7, the horizontal axis represents a rotation elapsed time of the fixing roller 64 at various rotational speeds of the fixing roller 64, and the vertical axis represents the temperature of the pressing roller 63.

As shown in FIG. 7, at the specific rotation elapsed time of the fixing roller 64 (for example, at a normal sheet passing as shown in FIG. 7), when the rotational speed of the fixing roller 64 is high (for example, the rotational speed=V0+ΔV as shown in FIG. 7), the temperature of the pressing roller 63 tends to increase more rapidly as compared with the normal rotational speed (for example, the rotational speed=V0 as shown in FIG. 7). In other words, the pressing roller 63 increases more rapidly at the higher rotational speed.

When the rotational speed of the fixing roller 64 is high, the fixing roller 64 with the higher temperature tends to contact with the pressing roller 63 the lower temperature more frequently. As a result, heat of the fixing roller 64 tends to transfer to the pressing roller 63 more frequently.

Accordingly, in the embodiment, when the temperature difference between the fixing roller 64 and the pressing roller 63 is larger, the rotational speed of the fixing roller 64 is set at a higher speed. On the other hand, when the temperature difference between the fixing roller 64 and the pressing roller 63 is smaller, the rotational speed of the fixing roller 64 is set at a lower speed. Accordingly, the rotational speed of the fixing roller 64 is controlled such that the temperature difference ΔT between the fixing roller 64 and the pressing roller 63 becomes closer to the specific temperature difference β.

In step S107, the print control unit 100 determines whether the temperature Tup of the fixing roller 64 is within the printable temperature range using the determination result of the temperature determining unit 102. When the print control unit 100 determines that the temperature Tup of the fixing roller 64 is within the printable temperature range, the process proceeds to step S108. On the other hand, when the print control unit 100 determines that the temperature Tup of the fixing roller 64 is outside the printable temperature range, the process returns to step S102, so that the fixing device temperature control process is continued.

In step S108, when the print control unit 100 determines that the temperature Tup of the fixing roller 64 is within the printable temperature range, that is, the fixing device 6 is in the printable state, the print control unit 100 starts the transportation of the sheet using the sheet transportation portion 4 and the image forming process using the toner image forming portion 5.

In step S109, the print control unit 100 determines whether the sheet reaches the fixing device 6 from the output of the writing sensor 8. When the print control unit 100 determines that the sheet does not reach the fixing device 6, the process returns to step S102. When the print control unit 100 determines that the sheet reaches the fixing device 6, the process proceeds to step S110.

When the print control unit 100 detects an output change of the writing sensor 8 and determines that a leading edge of the sheet reaches the position of the writing sensor 8, the print control unit 100 starts measurement of an elapsed time. A transportation distance of the sheet between the writing sensor 8 and the fixing device 6 is known in advance. Accordingly, through dividing the transportation distance of the sheet by the transportation speed of the sheet, it is possible to calculate a necessary time for the sheet to reach the position of the fixing device 6 from the position of the writing sensor 8. Accordingly, after the leading edge of the sheet reaches the position of the writing sensor 8, the print control unit 100 measures the elapsed time, so that the print control unit 100 determines whether the sheet reaches the fixing device 6.

In step S110, when the print control unit 100 determines that the sheet reaches the fixing device 6, the motor control unit 101 changes the rotational speed Vmot of the fixing roller 64 to the rotational speed V0 for the fixing process (the printing process). In step S111, while the sheet is passing through the fixing device 6, the heating control unit 104 continues the fixing device temperature control process, so that the temperature of the fixing roller 64 is controlled at the optimal temperature.

In step S112, the print control unit 100 detects the sheet transportation position from the output of the discharge sensor 9, and determines whether the sheet is passing through the fixing device 6. When the print control unit 100 determines that the sheet is passing through the fixing device 6, the process returns to step S110. When the print control unit 100 determines that the sheet is not passing through the fixing device 6, the process proceeds to step S113. In the embodiment, the print control unit 100 determines whether the sheet is passing through the fixing device 6 through the following process.

In the embodiment, the print control unit 100 detects the output of the discharge sensor 9, so that the print control unit 100 can determines that the leading edge of the sheet reaches the position of the discharge sensor 9. Afterward, as the sheet continues to be transported, the print control unit 100 detects the output of the discharge sensor 9, so that the print control unit 100 can determines that the trailing edge of the sheet passes through the position of the discharge sensor 9. As described above, the discharge sensor 9 is disposed on the downstream side of the fixing device 6 in the sheet transportation direction.

Accordingly, it is possible to detect that the sheet is discharged from the fixing device 6 when the discharge sensor 9 detects the trailing edge of the sheet. It may be configured such that the print control unit 100 measures an elapsed time from when the writing sensor 8 detects that the trailing edge of the sheet passes there trough to when the time that the sheet travels from the writing sensor 8 to the fixing device 6 is elapsed, so that the print control unit 100 determines that the sheet passes through the fixing device 6.

In step S113, when the print control unit 100 determines that the sheet is not passing through the fixing device 6, similar to step S106, the motor control unit 101 changes the rotational speed of the fixing roller 64 to the rotational speed Vmot as the optimal rotational speed of the fixing roller 64 given by the following equation according to the temperature difference ΔT between the fixing roller 64 and the pressing roller 63:

$$Vmot(mm/s)=V0+B\times(\Delta T-\beta)$$

In the following description, the rotational speed Vmot of the fixing roller 64 when the sheet is not passing through the fixing device 6, and the temperature differences ΔT and β between the fixing roller 64 and the pressing roller 63 will be explained in more detail, in comparison between the first embodiment and a comparison example.

In the comparison example, the rotational speed of the fixing roller 64 is set to V0 when the temperature difference ΔT between the fixing roller 64 and the pressing roller 63 is smaller than a specific temperature difference. When the temperature difference ΔT between the fixing roller 64 and the pressing roller 63 is greater than the specific temperature difference, the rotational speed of the fixing roller 64 is set to a maximum rotational speed Vmax.

In the comparison example, when the temperature difference ΔT is greater than the specific temperature difference even by one degree, the fixing roller 64 is rotated at the maximum rotational speed Vmax. Accordingly, the temperature difference ΔT between the fixing roller 64 and the pressing roller 63 tends to become significantly smaller than the specific temperature difference at the end of the between-sheets distance or the between-sheets period. Afterward, the fixing roller 64 is rotated at the rotational speed V0 at the subsequent between-sheets period. Accordingly, the temperature difference ΔT becomes greater than the specific temperature difference in the subsequent between-sheets period. In this case, the fixing roller 64 is rotated at the maximum rotational speed Vmax again.

In the comparison example, when the operation described above is repeated, the temperature repeatedly rises at the maximum rate and the minimum rate in the between-sheets period, thereby significantly fluctuating the temperature difference ΔT between the fixing roller 64 and the pressing roller 63. As described above, the heating control unit 104 controls the temperature of the fixing roller 64. As a result, the temperature Tlw of the fixing roller 64 tends to fluctuate greatly, thereby causing the large fluctuation in heat supplied to the sheet.

Figure 8:
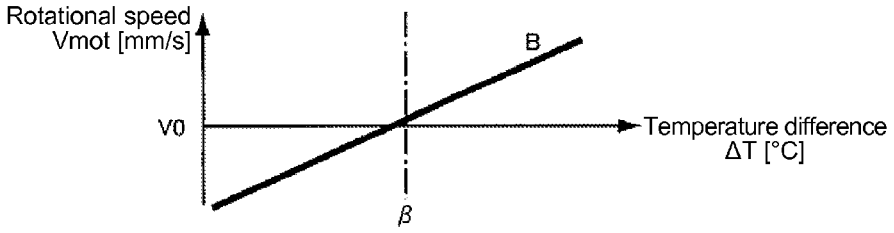
FIG. 8 is a graph showing a relationship between a rotational speed of the fixing roller and a temperature difference between the pressing roller and the fixing roller of the image forming apparatus according to the first embodiment of the present invention.

In contrast, in the embodiment, as shown in FIG. 8, the rotational speed Vmot of the fixing roller 64 is given by the following equation according to the temperature difference ΔT between the fixing roller 64 and the pressing roller 63:

$$Vmot(mm/s)=V0+B\times(\Delta T-\beta)$$

Accordingly, the rotational speed Vmot of the fixing roller 64 is adjusted according to the temperature difference ΔT (the inter-roller temperature difference) between the fixing roller 64 and the pressing roller 63. Further, the rotational speed Vmot of the fixing roller 64 is adjusted continuously according to the temperature difference ΔT.

In the embodiment, for example, when the temperature difference ΔT is slightly greater than the temperature difference β, the rotational speed of the fixing roller 64 is not increased greatly. As a result, the temperature of the pressing roller 63 is slightly increased in the between-sheets period as opposed to when the fixing roller 64 is rotated at the rotational speed V0 normally.

On the other hand, when the temperature difference ΔT is significantly greater than the temperature difference β, the rotational speed of the fixing roller 64 is significantly increased. As a result, the temperature of the pressing roller 63 is significantly increased in the between-sheets period as opposed to when the fixing roller 64 is rotated at the rotational speed V0 normally.

As described above, in the embodiment, the rotational speed of the fixing roller 64 is adjusted according to the difference between the temperature difference ΔT and the temperature difference β between the fixing roller 64 and the pressing roller 63 such that the difference is minimized. Accordingly, the temperature difference ΔT between the fixing roller 64 and the pressing roller 63 does not fluctuate to an excessive extent.

In other words, the rotational speed of the fixing roller 64 is adjusted according to the difference between the temperature difference ΔT and the temperature difference β between the fixing roller 64 and the pressing roller 63 such that the difference is minimized. As a result, it is possible to minimize the fluctuation of the temperature Tlw of the pressing roller 63. Accordingly, it is possible to stably supply heat to the sheet, thereby securing preventing a problem of insufficient fixing.

In step S114, the print control unit 100 determines whether the printing operation thus requested is completed. When the print control unit 100 determines that the printing operation is completed, the print control unit 100 completes the printing operation. When the print control unit 100 determines that the printing operation is not completed, the process returns to step S111, so that the fixing device temperature control process is resumed. It is noted that the print control unit 100 determines whether the printing operation thus requested is completed through, for example, confirming whether the printing operation instructed from the upper device is completely finished.

In the embodiment, through performing the process described above, the temperature difference ΔT between the fixing roller 64 and the pressing roller 63 is maintained within the specific temperature difference, thereby preventing the sheet from curling. Further, the temperature Tsp of the fixing roller 64 is adjusted according to the temperature Tlw of the pressing roller 63. Accordingly, it is possible to maintain heat supplied to the sheet at the constant level, thereby preventing a problem of insufficient fixing.

Figure 9:
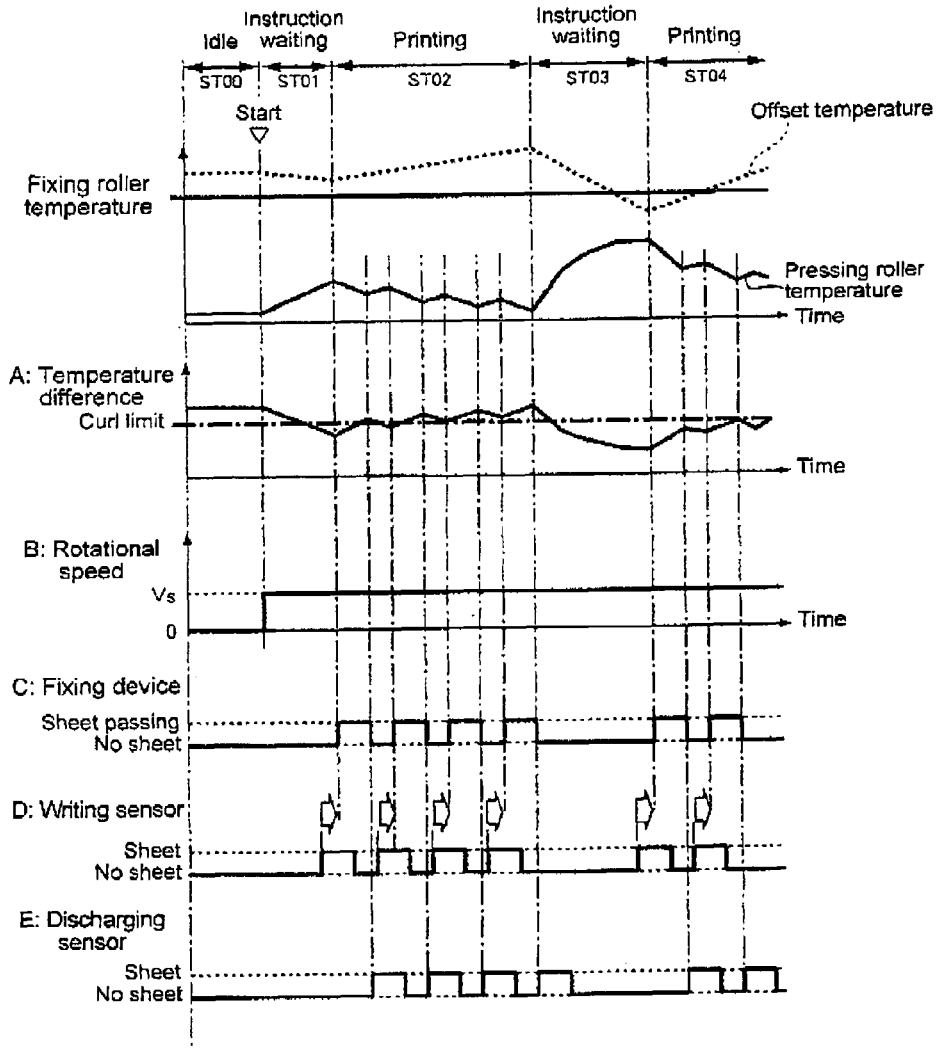
FIG. 9 is a time chart showing an operation of an image forming apparatus according to a comparative example.
Figure 10:
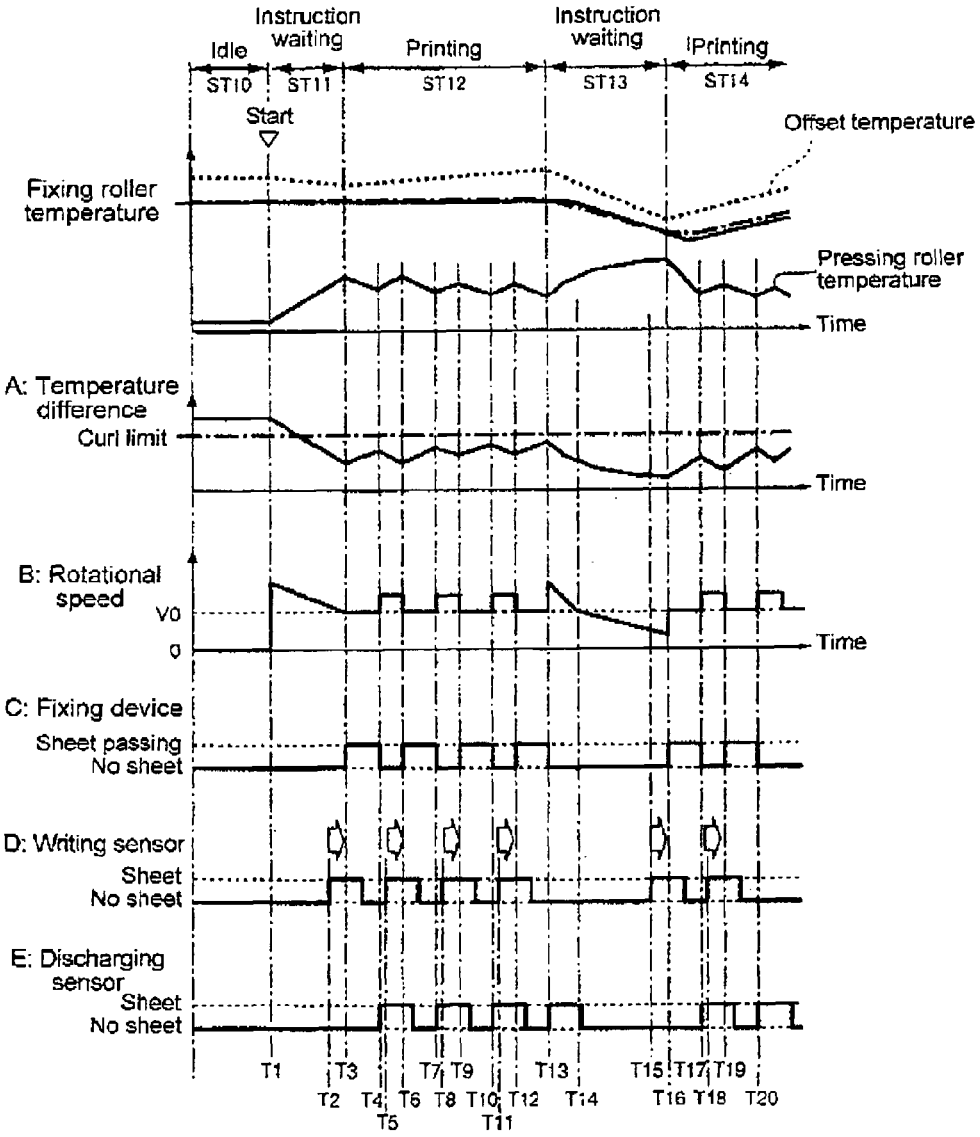
FIG. 10 is a time chart showing the operation of the image forming apparatus according to the first embodiment of the present invention.

The printing operation of the image forming apparatus 1 will be explained with reference to a timing chart shown in FIG. 10 in comparison with a printing operation of the comparative example with reference to a timing chart shown in FIG. 9. FIG. 9 is the time chart showing the printing operation of the image forming apparatus according to the comparative example. FIG. 10 is a time chart showing the printing operation of the image forming apparatus 1 according to the first embodiment of the present invention.

As shown in FIGS. 9 and 10, the horizontal axis represents an elapsed time. In the uppermost chart of FIGS. 9 and 10, the vertical axis represents the temperatures of the fixing roller 64 and the pressing roller 63 of the fixing device 6. In the following charts from the top, the vertical axes represent respectively the temperature difference (A: inter-roller temperature difference) between the fixing roller 64 and the pressing roller 63; the rotational speed (B: rotational speed) of the fixing device motor 21 (the fixing roller 64) controlled with the motor control unit 101; the sheet passing state in the fixing device 6 (C: fixing device sheet passing state) based on the detection results of the writing sensor 8 and the discharge sensor 9; the sheet detection result (D: writing sensor) of the writing sensor 8; and the sheet detection result (E: discharge sensor) of the discharge sensor 9.

As shown in FIGS. 9 and 10, in the horizontal axis, ST00 to ST04 periods represent a period of time. More specifically, ST00 period represents an idle state; ST01 period represents a print instruction waiting state; ST02 period represents a printing state; and ST03 period represents the print instruction waiting state; and ST04 period represents the printing state.

First, the printing operation of the image forming apparatus according to the comparative example will be explained with reference to FIG. 9. In ST00 period, corresponding to step S101 shown in FIG. 5, the print control unit 100 waits for the print request from the upper device. At this moment, the sheet transportation motor 18 stops, the writing sensor 8 and the discharge sensor 9 do not detect the sheet, and the sheet is not passing through the fixing device 6.

In ST01 period, when the print control unit 100 receives the print request, the temperature setting unit 103 sets the temperature of the fixing roller 64, and the fixing roller 64 and the pressing roller 63 start rotating, so that the image forming apparatus 1 is in the print instruction waiting state.

Further, the motor control unit 101 sets the rotational speed at Vs, so that the fixing device motor 21 starts rotating (to rotate the pressing roller 63 and the fixing roller 64). It is noted that the sheet is not transported yet at this moment. When the fixing roller 64 and the pressing roller 63 rotate, heat is transferred from the fixing roller 64 to the pressing roller 63. Accordingly, the temperature of the pressing roller 63 increases. It is noted that the rotational speed Vs of the fixing device motor 21 (the fixing roller 64) is constant during the printing operation. When the print control unit 100 determines that the temperature of the fixing roller 64 is within the printable temperature range, the print control unit 100 starts the transportation of the sheet and the image forming process.

In ST02 period, after the print control unit 100 starts the transportation of the sheet and the image forming process, the print control unit 100 performs the printing operation. When the print control unit 100 performs the printing operation, the sheet absorbs heat of the fixing roller 64 while passing through the fixing device 6, so that the temperature of the fixing roller 64 decreases. When several sheets are printed, the temperature of the fixing roller 64 gradually decreases further. When the sheet does not pass through the fixing device 6, the pressing roller 63 contacts with the fixing roller 64. Accordingly, the pressing roller 63 receives heat from the fixing roller 64, and the temperature of the fixing roller 64 increases. However, the pressing roller 63 does not contact with the fixing roller 64 often, so that the sheet absorbs more heat from the fixing roller 64. As a result, the temperature of the fixing roller 64 gradually decreases.

At this moment, the heating control unit 104 controls the fixing heater 61 such that the temperature of the fixing roller 64 is maintained constant, so that the temperature of the fixing roller 64 is maintained constant. As a result, as shown in FIG. 9, A: inter-roller temperature difference becomes larger gradually. As explained above, in the comparison example, the inter-roller temperature difference becomes larger and eventually exceeds a curl limit temperature difference, at which the sheet is curled. In general, the curl limit temperature difference is, for example, about 70° C.

In ST03 period, while the image processing unit of the upper device (not shown) performs the image processing, the print control unit 100 performs the fixing device temperature control process and rotate the fixing roller 64 and the pressing roller 63, thereby being in the print instruction waiting state. At this moment, the sheet is not passing through the fixing device 6, and the fixing roller 64 and the pressing roller 63 keep rotating in the print instruction waiting state. Accordingly, the temperature of the pressing roller 63 increases.

In ST04 period, the print control unit 100 starts the transportation of the sheet and the image forming process, thereby performing the printing operation. If the print instruction waiting state in ST03 period is prolonged and the fixing operation is performed, the sheet passes through the fixing device 6 in the state that the temperature of the pressing roller 63 becomes excessively high. Accordingly, a large quantity of heat is transferred to the sheet. As described above, in the comparison example, the printing operation and the fixing operation are performed without adjusting the set temperature of the fixing roller 64. As a result, an excessive quantity of heat is transferred from the pressing roller 63 to the sheet, and the temperature of the fixing roller 64 exceeds a hot offset generation temperature, thereby causing a fixing problem due to hot offset.

Next, the printing operation of the image forming apparatus 1 according to the first embodiment will be explained with reference to FIG. 10 according to timings T1 to T20.

At the timing T1, the print control unit 100 is in the idle state for waiting for the print request from the upper device (ST10 period). More specifically, the sheet transportation motor 18 stops, the writing sensor 8 and the discharge sensor 9 do not detect the sheet, and the sheet is not passing through the fixing device 6. When the print control unit 100 receives the print request, the print control unit 100 performs the fixing device temperature control process, and sets the rotational speed of the fixing roller 64. Further, the print control unit 100 starts the fixing roller 64 and the pressing roller 63 to rotate (step S102 to step S107 shown in FIG. 5), so that the image forming apparatus 1 is in the print instruction waiting state (ST11 period).

In the embodiment, as shown in FIG. 10, the inter-roller temperature difference A is large, so that the fixing roller 64 is rotated at a rotational speed higher than the rotational speed V0 at the printing operation. Afterward, the fixing temperature control process is performed and the rational speed of the fixing roller 64 is adjusted until the transportation of the sheet is started. Accordingly, the rational speed of the fixing roller 64 is adjusted according to the inter-roller temperature difference. That is, when the inter-roller temperature difference decreases, the rational speed of the fixing roller 64 is gradually reduced.

At the timing T2, when the print control unit 100 determines that the temperature of the fixing roller 64 is within the printable temperature range, the print control unit 100 determines that the fixing device 6 is in the printable state and starts the transportation of the sheet and the image forming process, so that the writing sensor 8 detects the sheet.

At the timing T3, when the print control unit 100 detects that the sheet reaches the fixing device 6 from the detection result of the writing sensor 8, the motor control unit 101 changes the rational speed of the fixing roller 64 to the rotational speed V0 for the fixing operation.

At the timing T4, when the print control unit 100 detects that the sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

At the timing T5, the print control unit 100 continues the transportation of the sheet and the image forming process, and the writing sensor 8 detects the second sheet thus transported.

At the timing T6, when the print control unit 100 detects that the second sheet reaches the fixing device 6 from the detection result of the writing sensor 8, the motor control unit 101 changes the rational speed of the fixing roller 64 to the rotational speed V0 for the fixing operation.

At the timing T7, when the print control unit 100 detects that the second sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

At the timing T8, the print control unit 100 continues the transportation of the sheet and the image forming process, and the writing sensor 8 detects the third sheet thus transported.

At the timing T9, when the print control unit 100 detects that the third sheet reaches the fixing device 6 from the detection result of the writing sensor 8, the motor control unit 101 changes the rational speed of the fixing roller 64 to the rotational speed V0 for the fixing operation.

At the timing T10, when the print control unit 100 detects that the third sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

At the timing T11, the print control unit 100 continues the transportation of the sheet and the image forming process, and the writing sensor 8 detects the fourth sheet thus transported.

At the timing T12, when the print control unit 100 detects that the fourth sheet reaches the fixing device 6 from the detection result of the writing sensor 8, the motor control unit 101 changes the rational speed of the fixing roller 64 to the rotational speed V0 for the fixing operation.

At the timing T13, when the print control unit 100 detects that the fourth sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

As described above, in the printing state (ST12 period), the motor control unit 101 repeatedly adjusts the rotational speed of the fixing roller 64 according to the inter-roller temperature difference while the sheet is not passing through the fixing device 6. Accordingly, it is possible to increase the temperature of the fixing roller 64 while the sheet is not passing through the fixing device 6. As a result, as shown in FIG. 10, it is possible to maintain the inter-roller temperature difference A below the curl limit temperature difference, at which the sheet tends to be curled.

After the fourth sheet is printed, while the image processing unit of the upper device (not shown) performs the image processing, the print control unit 100 performs the fixing device temperature control process and rotate the fixing roller 64 and the pressing roller 63, thereby being in the print instruction waiting state (ST13 period). At this moment, the sheet is not passing through the fixing device 6, and the fixing roller 64 and the pressing roller 63 keep rotating in the idle state.

In the embodiment, even when the temperature of the pressing roller 63 increases through the rotation of the fixing roller 64 and the pressing roller 63 while the sheet is not passing through the fixing device 6, the temperature setting unit 103 adjusts the temperature of the fixing roller 64 according to the inter-roller temperature difference. Further, the motor control unit 101 adjusts the rotational speed of the fixing roller 64 according to the inter-roller temperature difference.

At the timing T14, when the temperature of the pressing roller 63 increases further, the motor control unit 101 changes the rotational speed of the fixing roller 64 to the rotational speed corresponding to the inter-roller temperature difference thus decreased, that is, the rotational speed lower than the rotational speed V0. As a result, when the image forming apparatus 1 becomes the printing state (ST14 period) again and the sheet starts passing through the fixing device 6, the set temperature of the fixing roller 64 becomes the low set temperature according to the temperature of the pressing roller 63 thus increased. Further, the rotational speed of the fixing roller 64 is adjusted to the low rotational speed corresponding to the inter-roller temperature difference thus decreased. Accordingly, a proper quantity of heat is supplied to the sheet, thereby preventing the offset.

Further, even when the sheet passes through the fixing device 6 again and the temperature of the pressing roller 63 decreases, the set temperature of the fixing roller 64 becomes the high set temperature according to the temperature of the pressing roller 63 thus decreased. Further, the rotational speed of the fixing roller 64 is adjusted to the high rotational speed corresponding to the inter-roller temperature difference thus increased. Accordingly, a proper quantity of heat is supplied to the sheet, thereby preventing the offset.

At the timing T15, the print control unit 100 starts the transportation of the sheet and the image forming process according to the print instruction from the upper device (not shown), so that the writing sensor 8 detects the sheet thus transported.

At the timing T16, when the print control unit 100 detects that the fifth sheet reaches the fixing device 6 from the detection result of the writing sensor 8, the motor control unit 101 changes the rational speed of the fixing roller 64 to the rotational speed V0 for the fixing operation.

At the timing T17, when the print control unit 100 detects that the fifth sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

At the timing T18, the print control unit 100 continues the transportation of the sheet and the image forming process, and the writing sensor 8 detects the sixth sheet thus transported.

At the timing T19, when the print control unit 100 detects that the sixth sheet reaches the fixing device 6 from the detection result of the writing sensor 8, the motor control unit 101 changes the rational speed of the fixing roller 64 to the rotational speed V0 for the fixing operation.

At the timing T20, when the print control unit 100 detects that the sixth sheet is discharged outside the fixing device 6 from the detection result of the discharge sensor 9 and determines that the sheet is not passing through the fixing device 6, the motor control unit 101 changes the rotational speed of the fixing roller 64 according to the inter-roller temperature difference.

As described above, in the first embodiment, during the printing operation, the temperature difference between the fixing roller 64 and the pressing roller 63 is adjusted to be within the specific temperature difference. Accordingly, even when the fixing heater 61 is not disposed in the pressing roller 63 of the fixing device 6, it is possible to prevent the sheet from being curled. Further, the temperature of the fixing roller 64 is adjusted according to the temperature of the pressing roller 63. Accordingly, it is possible to supply a constant quantity of heat to the sheet, thereby preventing the fixing problem due to the offset.

Further, in the first embodiment, the rational speed of the fixing roller 64 is adjusted according to the temperature difference between the fixing roller 64 and the pressing roller 63. Accordingly, it is possible to prevent the fixing problem due to the offset.

Second Embodiment

A second embodiment of the present invention will be explained next. In the second embodiment, different from the first embodiment, the image forming apparatus 1 includes a print control unit 200, a motor control unit 201, and a temperature setting unit 203. Other components in the second embodiment similar to those in the first embodiment are designated with the same reference numerals, and explanations thereof are omitted.

Figure 11:
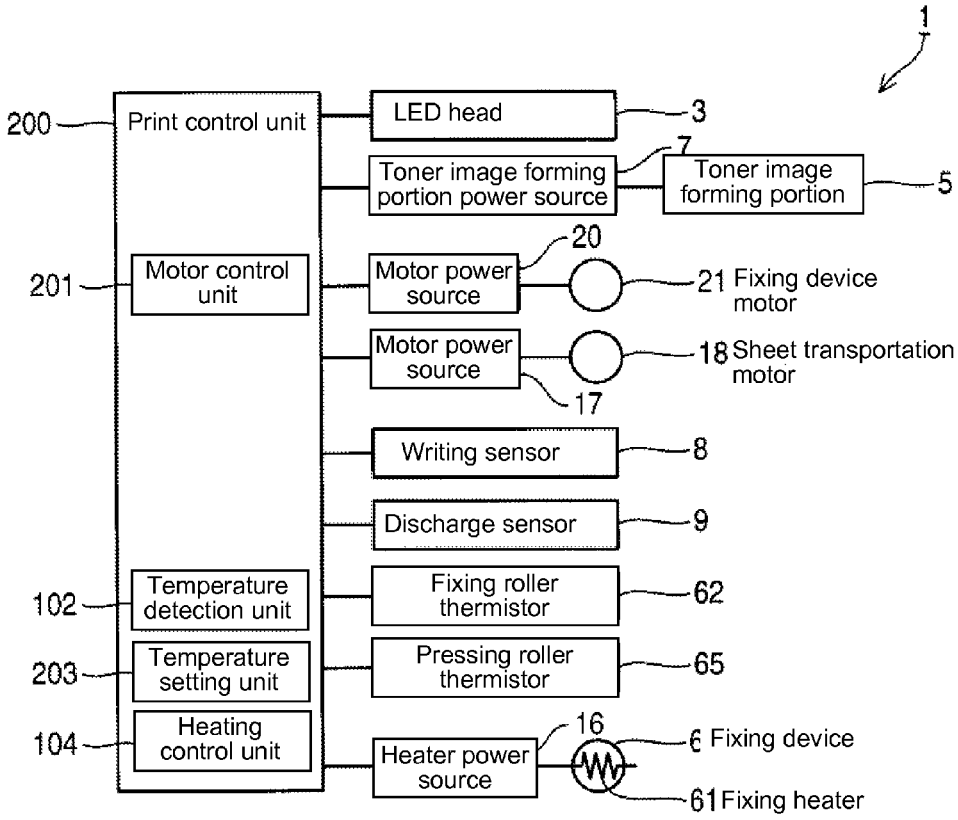
FIG. 11 is a block diagram showing a configuration of a control system of an image forming apparatus according to a second embodiment of the present invention.

FIG. 11 is a block diagram showing a configuration of a control system of the image forming apparatus 1 according to the second embodiment of the present invention.

As shown in FIG. 11, the image forming apparatus 1 includes the print control unit 200 for controlling the printing operation of the image forming apparatus 1; the LED head 3 as the recording light exposure unit; the toner image forming portion 5 for forming the toner image according to recording light; the toner image forming portion power source 7 for applying the voltage to the toner image forming portion 5; the sheet transportation motor 18 for rotating various rollers that transport the sheet; the motor power source 17 for supplying electric power to the sheet transportation motor 18; the fixing device motor 21 for rotating the pressing roller 63 and the fixing roller 64 of the fixing device 6; and the motor power source 20 for supplying electric power to the fixing device motor 21.

Further, the image forming apparatus 1 includes the writing sensor 8 and the discharge sensor 9 for detecting the position of the sheet thus transported; the fixing device 6 having the fixing heater 61 that heats the fixing roller 64 (refer to FIG. 2); the heater power source 16 for supplying electric power to the heater power source 16; the fixing roller thermistor 62 for detecting the temperature of the fixing roller 64 as the fixing member of the fixing device 6 (refer to FIG. 2); and the pressing roller thermistor 65 for detecting the temperature of the pressing roller 63 as the pressing member of the fixing device 6 (refer to FIG. 2).

In the embodiment, the print control unit 200 is formed of a CPU (Center Processing Unit) as a calculation unit or a control unit and a memory and the like as a storage unit. The print control unit 200 includes the motor control unit 201; the temperature determining unit 102; the temperature setting unit 203; and the heating control unit 104, so that the print control unit 100 controls the printing operation of the image forming apparatus 1. Further, the print control unit 200 includes a timing unit such as a timer and the like for measuring an elapsed time.

In the embodiment, the motor control unit 201 as the rotational speed control unit is provided for controlling electric power supplied from the motor power source 17, so that the motor control unit 201 controls the operation of the sheet transportation motor 18. Further, the motor control unit 101 is provided for controlling electric power supplied from the motor power source 20, so that the motor control unit 101 controls the operation of the fixing device motor 21. The sheet transportation motor 18 is connected to various rollers of the sheet transportation portion 4 (refer to FIG. 2), and the fixing device motor 21 is connected to the fixing roller 64 (refer to FIG. 2). The motor control unit 201 is configured to control the rotational speeds of the rollers of the sheet transportation portion 4 and the fixing roller 64.

In the embodiment, the motor control unit 201 is further provided as a medium transportation control unit for controlling the rollers of the sheet transportation portion 4 including the sheet supply roller to change a timing of transporting the sheet stored in the sheet tray, so that the motor control unit 201 is capable of adjusting a no-sheet passing time (a time interval between the sheets to be printed) during the continuous printing operation. In other words, the motor control unit 201 is configured to adjust a transportation interval of the sheet. Further, the temperature setting unit 203 is provided as the temperature setting unit for selecting and setting an optimal temperature of the fixing device 6 according to the operational condition of the image forming apparatus 1.

In the embodiment, the print control unit 200 is connected to the LED head 3, the toner image forming portion power source 7, the motor power source 17, the motor power source 20, the writing sensor 8, the discharge sensor 9, the fixing roller thermistor 62, the pressing roller thermistor 65, and the heater power source 16. Further, the toner image forming portion power source 7 is connected to the toner image forming portion 5, and the motor power source 17 is connected to the sheet transportation motor 18. Further, the motor power source 20 is connected to the fixing device motor 21, and the heater power source 16 is connected to the fixing heater 61.

Figure 13:
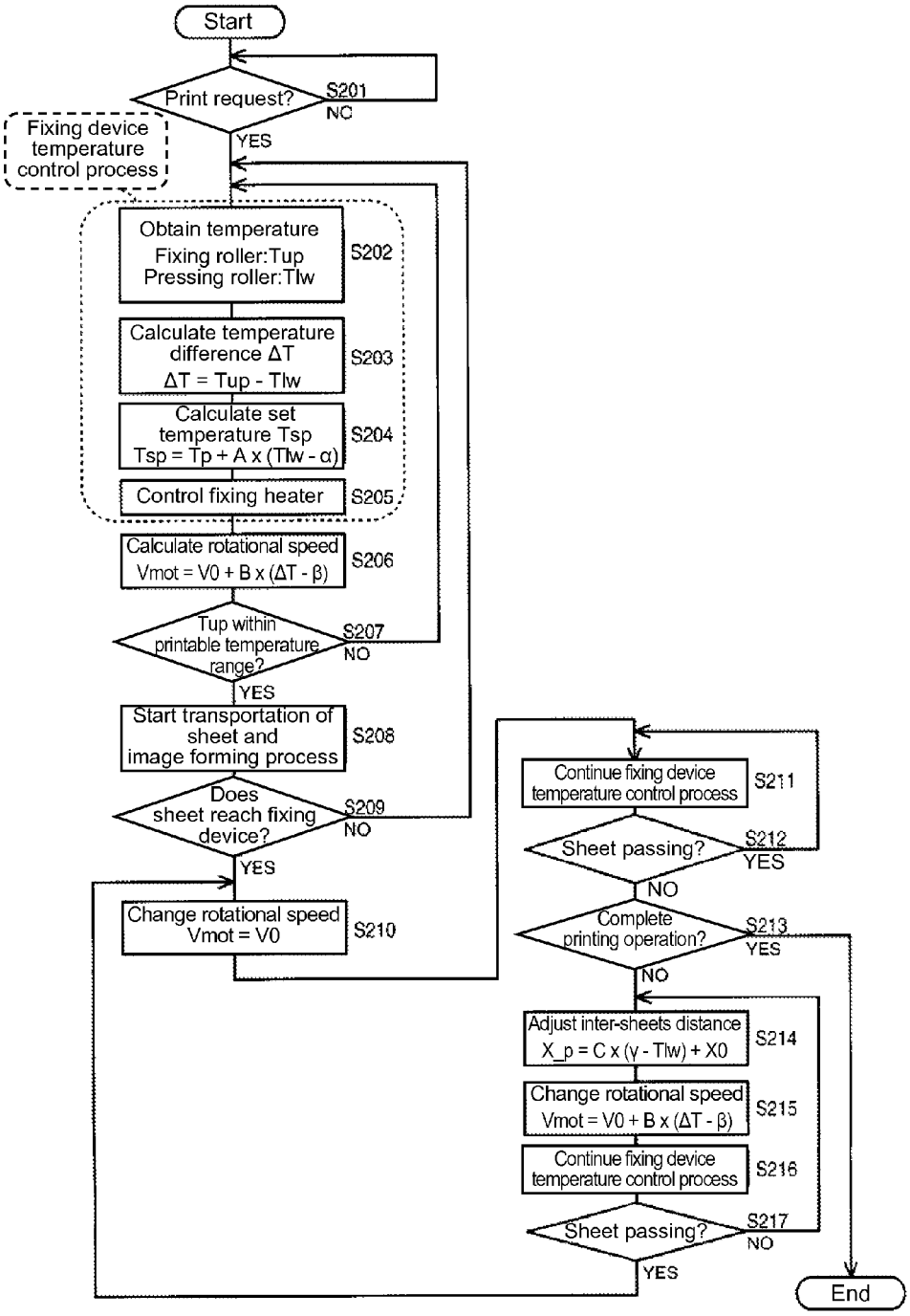
FIG. 13 is a flow chart showing an operation of the image forming apparatus according to the second embodiment of the present invention.

An operation of the image forming apparatus 1 will be explained with reference to a flow chart shown in FIG. 13 as well as FIGS. 11, 2, and 3. FIG. 13 is the flow chart showing the operation of the image forming apparatus 1 according to the second embodiment of the present invention. The process from step S201 to step S212 is similar to that from step S101 to step S112 shown in FIG. 5, and an explanation thereof is omitted.

In step S213, the print control unit 100 determines whether the printing operation thus requested is completed.

When the print control unit 100 determines that the printing operation is completed, the print control unit 100 completes the printing operation. When the print control unit 100 determines that the printing operation is not completed, the process proceeds to step S214. It is noted that the print control unit 100 determines whether the printing operation thus requested is completed through, for example, confirming whether the printing operation instructed from the upper device is completely finished.

In step S213, when the print control unit 100 determines that the printing operation is not completed and the sheet is not passing through the fixing device 6, the motor control unit 201 calculates an optimal inter-sheets distance X_p (mm) (the transportation interval of the sheets) for preventing the sheet from being curled through the following equations:

when the temperature Tlw of the pressing roller 63 is smaller than γ (C.°)

$$X_p(mm)=C\times(\gamma-Tlw)+X0$$

when the temperature Tlw of the pressing roller 63 is equal to or greater than γ (C.°)

$$X_p(mm)=X0$$

Figure 15A:
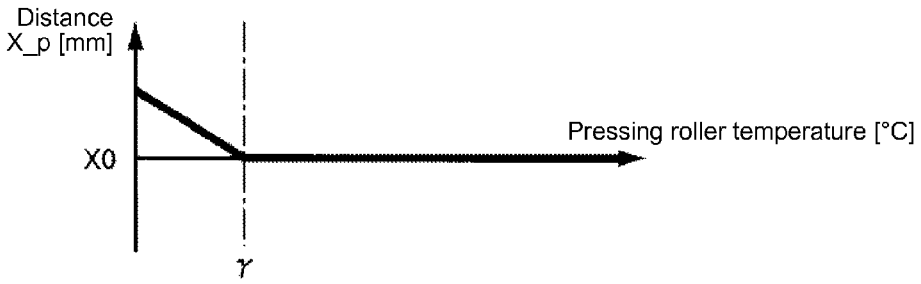
FIG. 15(*a*) is a graph showing a relationship between a sheet transportation interval and a temperature of the pressing roller of the image forming apparatus according to the second embodiment of the present invention.
Figure 15B:
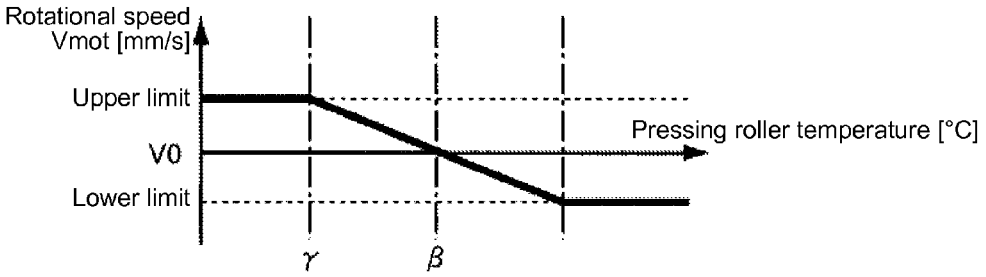

FIG. 15(*a*) is a graph showing a relationship between the sheet transportation interval and the temperature of the pressing roller 63 of the image forming apparatus 1 according to the second embodiment of the present invention.

As shown in FIG. 15(*a*), the above equations are represented with the graph.

In the above equations, γ (C.°) represents a specific lower limit temperature of the pressing roller 63, at which it is possible to maintain the inter-roller temperature difference within a specific range through adjusting the rational speed of the fixing roller 64. When the temperature Tlw of the pressing roller 63 is smaller than γ (C.°), the inter-sheets distance X_p (mm) is necessary for preventing the sheet from being curled. When the temperature Tlw of the pressing roller 63 is equal to or greater than γ(C.°), the inter-sheets distance X_p (the transportation interval of the sheets) needs to be X0 (mm) for preventing the sheet from being curled.

In the above equations, C represents a coefficient as a proportional constant for calculating the optimal inter-sheets distance. In the embodiment, the inter-sheets distance X0, the lower limit temperature γ, and the coefficient C can be obtained through an experiment. For example, the inter-sheets distance X0 may be 60 mm, the lower limit temperature γ may be 60 C.°, and the coefficient C may be 1.5. In this case, the inter-sheets distance X_p is calculated as follows:

$$X_p(mm)=1.5\times(60-Tlw)+60$$

Accordingly, when the temperature Tlw of the pressing roller 63 is 30 C.°, the inter-sheets distance X_p is calculated to be 105 (mm).

Figure 14:
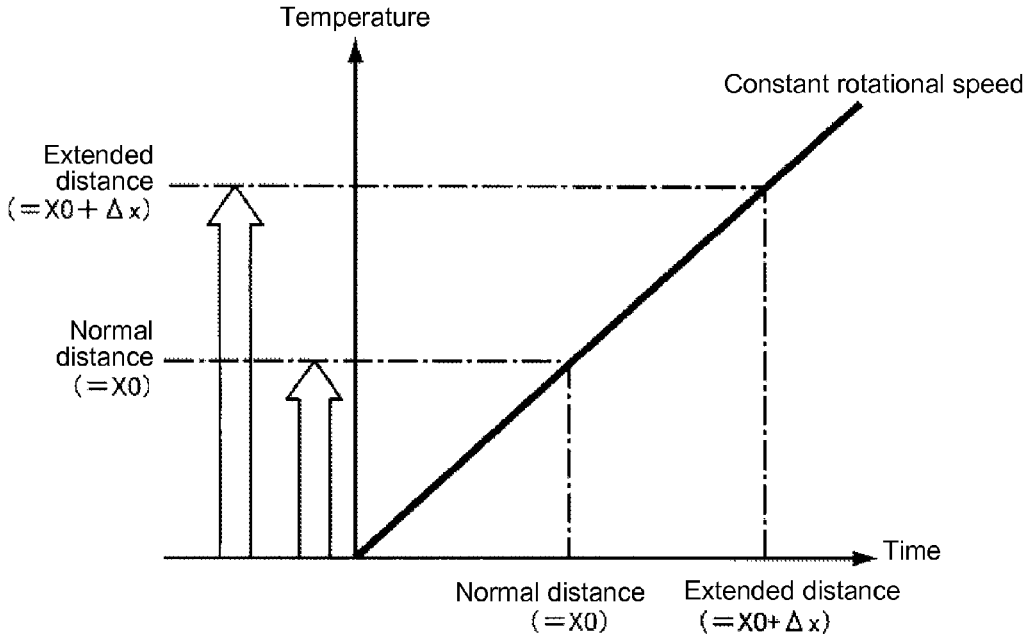
FIG. 14 is a graph showing a time change in a temperature of a pressing roller of a fixing device of the image forming apparatus according to the second embodiment of the present invention.

A relationship between the inter-sheets distance and the temperature of the pressing roller 63 will be explained next. FIG. 14 is a graph showing a time change in the temperature of the pressing roller 63 of the fixing device 6 of the image forming apparatus 1 according to the second embodiment of the present invention. In FIG. 14, the horizontal axis represents an elapsed time at various inter-sheets distances, and the vertical axis represents the temperature of the pressing roller 63.

As shown in FIG. 14, the temperature of the pressing roller 63 is higher when the inter-sheets distance is extended (the inter-sheets distance=X0+Δx), as compared with when the inter-sheets distance is normal (the inter-sheets distance=X0).

When the inter-sheets distance is extended, the fixing roller 64 and the pressing roller 63 are rotated for a longer period of time. Accordingly, the fixing roller 64 with the higher temperature tends to contact with the pressing roller 63 with the lower temperature for a longer period of time. As a result, a larger quantity of heat is transferred from the fixing roller 64 to the pressing roller 63. Accordingly, in the embodiment, when the temperature difference between the fixing roller 64 and the pressing roller 63 increases, the inter-sheets distance is extended. In contrast, when the temperature difference between the fixing roller 64 and the pressing roller 63 is decreased, the inter-sheets distance is shortened. Accordingly, it is possible to control the temperature difference ΔT between the fixing roller 64 and the pressing roller 63 to be closer to the specific temperature difference.

In step S215, similar to the first embodiment, the motor control unit 101 calculates the rotational speed Vmot of the fixing roller 64 as the optimal rotational speed given by the following equation according to the temperature difference ΔT between the fixing roller 64 and the pressing roller 63:

$$Vmot(mm/s)=V0+B\times(\Delta T-\beta)$$

where V0 (mm/s) is the rotational speed of the fixing roller 64 upon fixing, and β (° C.) is the temperature difference between the fixing roller 64 and the pressing roller 63 when the sheet is prevented from being curled at the rotational speed V0. B is the coefficient representing the relationship between the rotational speed and the temperature difference necessary to change the temperature difference between the fixing roller 64 and the pressing roller 63 from the current temperature difference between the fixing roller 64 and the pressing roller 63 to the temperature difference β when the leading edge of the sheet reaches the fixing roller 64.

In the embodiment, a lower limit and an upper limit are set to the rotational speed Vmot thus calculated. More specifically, the upper limit of the rotational speed Vmot is set according to, for example, a constraint such as a type or performance of the motor used in the image forming apparatus 1. The lower limit of the rotational speed Vmot is set according to, for example, vibrations of the motor used in the image forming apparatus 1.

FIG. 15(*b*) is a graph showing a relationship between the rotational speed of the fixing roller 64 of the fixing device 6 and the temperature of the pressing roller 63 of the fixing device 6 of the image forming apparatus 1 according to the second embodiment of the present invention.

As shown in FIG. 15(*b*), when the temperature of the pressing roller 63 is lower than the lower limit temperature γ, the rotational speed of the fixing roller 64 becomes the upper limit. In contrast, when the temperature of the pressing roller 63 is higher than the lower limit temperature γ, the rotational speed of the fixing roller 64 is calculated with the following equation:

$$Vmot(mm/s)=V0+B\times(\Delta T-\beta)$$

Further, when the rotational speed of the fixing roller 64 reaches the lower limit, the rotational speed Vmot of the fixing roller 64 is maintained at the lower limit. The upper limit of the rotational speed Vmot of the fixing roller 64 may be, for example, 230 mm/s, and the lower limit of the rotational speed Vmot of the fixing roller 64 may be, for example, 50 mm/s.

When the sheet has an extremely low temperature, or an extremely large thickness, or an extremely high thermal conductivity, the sheet tends to absorb a large quantity of heat. When the sheet absorbs a large quantity of heat from the pressing roller 63 (and the fixing roller 64), it is necessary to rotate the fixing roller 64 at a high rotational speed to reduce the temperature difference between the fixing roller 64 and the pressing roller 63. However, if the rotational speed of the fixing roller 64 reaches the upper limit, it may be difficult to reduce the temperature difference between the fixing roller 64 and the pressing roller 63. In this case, the temperature difference between the fixing roller 64 and the pressing roller 63 may become extremely large, thereby causing the sheet to curl.

Figure 12:
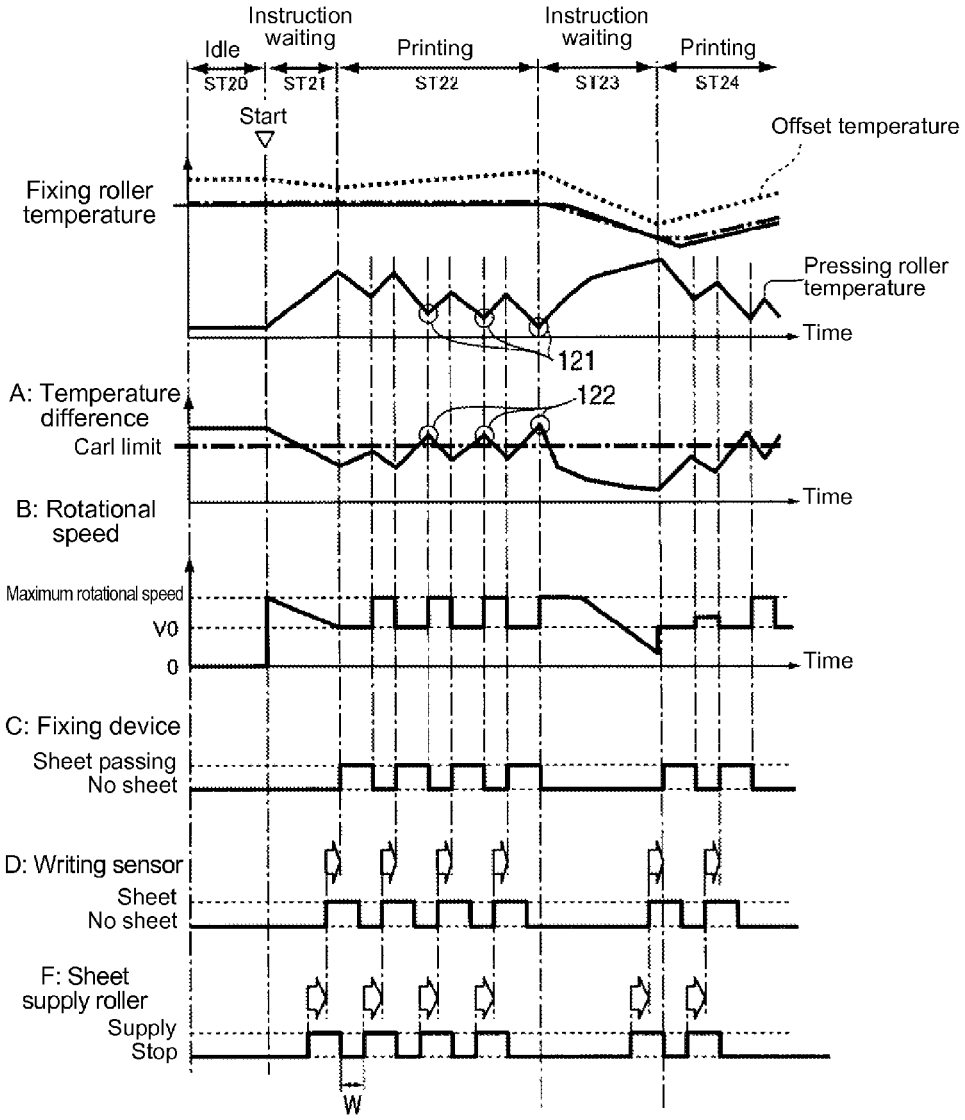
FIG. 12 is a time chart showing the operation of the image forming apparatus when a print sheet absorbs a large quantity of heat according to the first embodiment of the present invention.

FIG. 12 is a time chart showing the operation of the image forming apparatus 1 when the print sheet absorbs a large quantity of heat according to the first embodiment of the present invention.

As shown in FIG. 12, when the motor control unit 101 stops the sheet supply roller for a specific period of time W (s) (W=X0/Vp, Vp is the rotational speed of the sheet supply roller), that is, the inter-sheets distance is X0, the sheet absorbs heat. Accordingly, the temperature of the pressing roller 63 is decreased in regions 121, and the inter-roller temperature difference between the fixing roller 64 and the pressing roller 63 is increased in regions 122. When the inter-roller temperature difference between the fixing roller 64 and the pressing roller 63 exceeds the curl limit, the sheet tends to be curled.

To this end, in the second embodiment, when the rotational speed of the fixing roller 64 reaches the upper limit, it is configured such that the rotational speed of the fixing roller 64 is maintained at the upper limit. Further, the inter-sheets distance is adjusted in step S214. Accordingly, even if the sheet absorbs a large quantity of heat from the pressing roller 63 (and the fixing roller 64), it is possible to prevent the sheet from being curled. Further, the inter-sheets distance is adjusted according to the adjustment of the rotational speed of the fixing roller 64. Accordingly, it is possible to minimize throughput reduction.

In the embodiment, the lower limit temperature γ (C.°) of the pressing roller 63 is set so that it is possible to minimize the inter-roller temperature difference by rotating the fixing roller 64 at the upper limit. When the temperature of the pressing roller 63 exceeds the lower limit temperature γ (C.°), that is, it is difficult to minimize the inter-roller temperature difference by rotating the fixing roller 64 at the upper limit, the inter-sheets distance is extended. Accordingly, when it is difficult to minimize the inter-roller temperature difference only by rotating the fixing roller 64 at the upper limit, it is possible to maintain the inter-roller temperature difference within the optimal range, thereby preventing the sheet from being curled.

In step S216, the heating control unit 104 continues the fixing device temperature control process as described above, so that the temperature of the fixing roller 64 is maintained at the optimal temperature. In step S217, the print control unit 200 determines whether the sheet is passing through the fixing device 6, that is, the sheet completely passes through the fixing device 6, according to the detection result of the discharge sensor 9. When the print control unit 200 determines that the sheet is passing through the fixing device 6, the process returns to step S210. When the print control unit 200 determines that the sheet does not pass through the fixing device 6 completely, the process returns to step S214.

Figure 16:
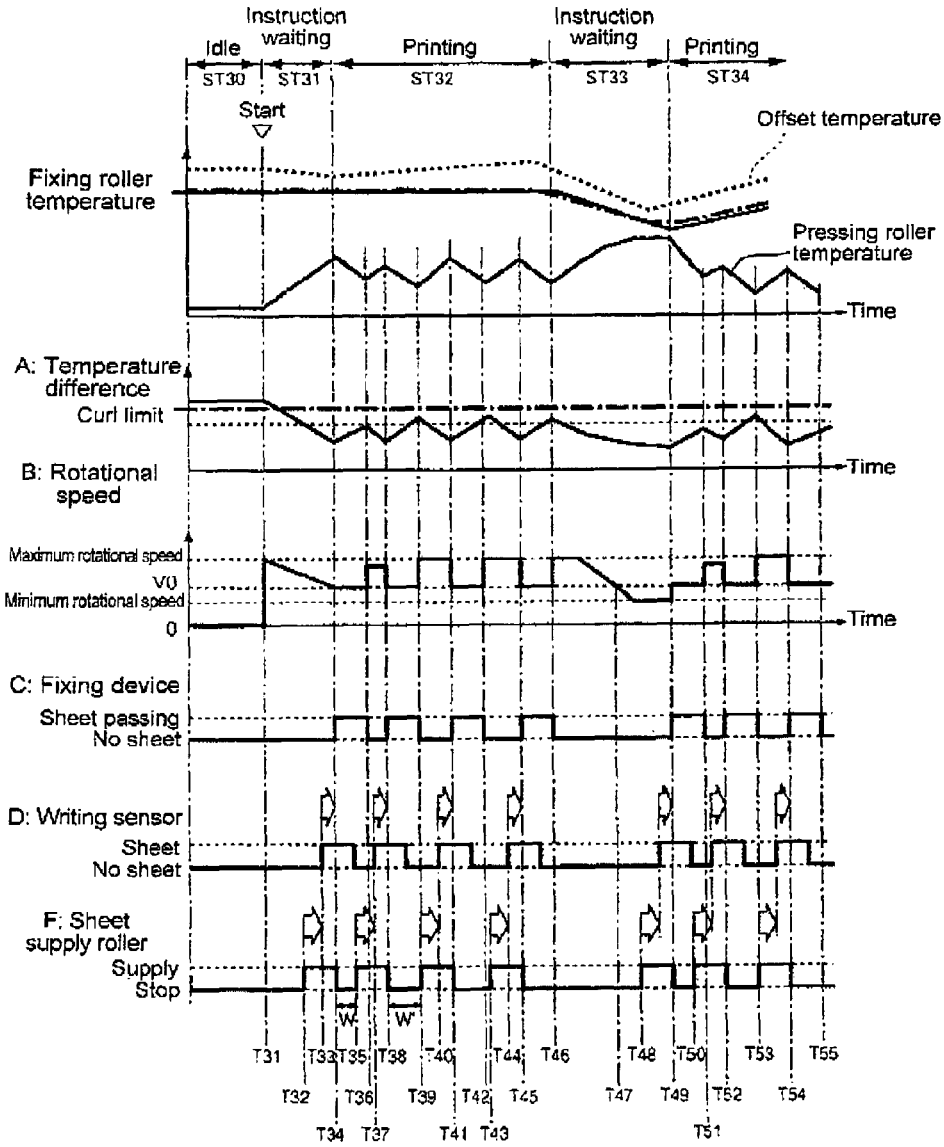
FIG. 16 is a time chart showing the operation of the image forming apparatus according to the second embodiment of the present invention.

Next, the printing operation of the image forming apparatus 1 according to the second embodiment will be explained with reference to FIGS. 11 and 16 according to timings T31 to T55. FIG. 16 is a time chart showing the printing operation of the image forming apparatus 1 according to the second embodiment of the present invention.

At the timing T31, the print control unit 200 is in the idle state for waiting for the print request from the upper device (ST30 period). More specifically, the sheet transportation motor 18 stops, the writing sensor 8 and the discharge sensor 9 do not detect the sheet, and the sheet is not passing through the fixing device 6.

When the print control unit 200 receives the print request, the print control unit 200 performs the fixing device temperature control process, and sets the rotational speed of the fixing roller 64. Further, the print control unit 100 starts the fixing roller 64 and the pressing roller 63 to rotate (step S202 to step S207 shown in FIG. 13), so that the image forming apparatus 1 is in the print instruction waiting state (ST31 period).

In the embodiment, as shown in FIG. 16, the inter-roller temperature difference A is large, so that the fixing roller 64 is rotated at a rotational speed higher than the rotational speed V0 at the printing operation. Afterward, the fixing temperature control process is performed and the rational speed of the fixing roller 64 is adjusted until the transportation of the sheet is started. Accordingly, the rational speed of the fixing roller 64 is adjusted according to the inter-roller temperature difference. That is, when the inter-roller temperature difference decreases, the rational speed of the fixing roller 64 is gradually reduced.

At the timing T32, when the print control unit 200 determines that the temperature of the fixing roller 64 is within the printable temperature range, the print control unit 200 determines that the fixing device 6 is in the printable state and starts the transportation of the sheet and the image forming process. At the timing T33, the writing sensor 8 detects the sheet.

At the timing T34, the motor control unit 201 stops the sheet supply roller. Further, when the print control unit 200 detects that the sheet reaches the fixing device 6 from the detection result of the writing sensor 8, the motor control unit 201 changes the rational speed of the fixing roller 64 to the rotational speed V0 for the fixing operation.

At the timing T35, when the print control unit 200 determines that the specific period of time W is elapsed after the sheet supply roller stops, the motor control unit 201 starts the sheet supply roller to start transporting the second sheet. During the specific period of time W, the inter-sheets distance becomes equal to X0 (mm). When the sheet supply roller rotates at the rotational speed Vp (mm/s), the specific period of time W is given by the following equation:

$$W(s)=X0/Vp$$

At the timing T36, when the print control unit 200 detects that the sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference.

At the timing T37, the print control unit 200 continues the transportation of the sheet and the image forming process, and the writing sensor 8 detects the second sheet thus transported.

At the timing T38, the motor control unit 201 stops the sheet supply roller. Further, when the print control unit 200 detects that the second sheet reaches the fixing device 6 from the detection result of the writing sensor 8, the motor control unit 201 changes the rational speed of the fixing roller 64 to the rotational speed V0 for the fixing operation.

At the timing T39, when the print control unit 200 detects that the second sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference. At this moment, it is supposed that the calculated rotational speed reaches the upper limit of the rotational speed of the fixing roller 64.

Further, when the print control unit 200 determines that the specific period of time W' is elapsed after the sheet supply roller stops, the motor control unit 201 starts the sheet supply roller to start transporting the third sheet. During the specific period of time W', the inter-sheets distance becomes equal to X_p (mm) calculated in step S214 shown in FIG. 13. When the sheet supply roller rotates at the rotational speed Vp (mm/s), the specific period of time W' is given by the following equation:

$$W'(s)=X_p/Vp$$

At the timing T40, the print control unit 200 continues the transportation of the sheet and the image forming process, and the writing sensor 8 detects the third sheet thus transported.

At the timing T41, when the print control unit 200 detects that the third sheet reaches the fixing device 6 from the detection result of the writing sensor 8, the motor control unit 201 changes the rational speed of the fixing roller 64 to the rotational speed V0 for the fixing operation. Further, the motor control unit 201 stops the sheet supply roller.

At the timing T42, when the print control unit 200 detects that the third sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference. At this moment, it is supposed that the calculated rotational speed reaches the upper limit of the rotational speed of the fixing roller 64.

At the timing T43, when the print control unit 200 determines that the specific period of time W' is elapsed after the sheet supply roller stops, the motor control unit 201 starts the sheet supply roller to start transporting the fourth sheet. During the specific period of time W', the inter-sheets distance becomes equal to X_p (mm) calculated in step S214 shown in FIG. 13. When the sheet supply roller rotates at the rotational speed Vp (mm/s), the specific period of time W' is given by the following equation:

$$W'(s)=X_p/Vp$$

At the timing T44, the print control unit 200 continues the transportation of the sheet and the image forming process, and the writing sensor 8 detects the fourth sheet thus transported.

At the timing T45, when the print control unit 200 detects that the fourth sheet reaches the fixing device 6 from the detection result of the writing sensor 8, the motor control unit 201 changes the rational speed of the fixing roller 64 to the rotational speed V0 for the fixing operation. Further, the motor control unit 201 stops the sheet supply roller.

At the timing T46, when the print control unit 200 detects that the fourth sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference.

As described above, in the printing state (ST32 period), the motor control unit 201 repeatedly adjusts the rotational speed of the fixing roller 64 according to the inter-roller temperature difference while the sheet is not passing through the fixing device 6. Accordingly, it is possible to increase the temperature of the fixing roller 64 while the sheet is not passing through the fixing device 6. As a result, as shown in FIG. 16, it is possible to maintain the inter-roller temperature difference A below the curl limit temperature difference, at which the speed tends to be curled.

Further, when the rational speed of the fixing roller 64 reaches the upper limit, the rational speed is maintained at the upper limit. Moreover, the inter-sheets distance is adjusted as calculated in step S214 shown in FIG. 13. Accordingly, it is possible to prevent the sheet from being curled even when the sheet absorbs a large quantity of heat from the pressing roller 63 (and the fixing roller 64).

After the fourth sheet is printed, while the image processing unit of the upper device (not shown) performs the image processing, the print control unit 200 performs the fixing device temperature control process and rotate the fixing roller 64 and the pressing roller 63, thereby being in the print instruction waiting state (ST33 period). At this moment, the sheet is not passing through the fixing device 6, and the fixing roller 64 and the pressing roller 63 keep rotating in the idle state.

In the embodiment, even when the temperature of the pressing roller 63 increases through the rotation of the fixing roller 64 and the pressing roller 63 while the sheet is not passing through the fixing device 6, the temperature setting unit 203 adjusts the temperature of the fixing roller 64 according to the inter-roller temperature difference.

Further, the motor control unit 201 adjusts the rotational speed of the fixing roller 64 according to the inter-roller temperature difference. When the rational speed of the fixing roller 64 reaches the upper limit, the rational speed of the fixing roller 64 is maintained at the upper limit.

At the timing T47, when the temperature of the pressing roller 63 increases further, the motor control unit 201 changes the rotational speed of the fixing roller 64 to the rotational speed corresponding to the inter-roller temperature difference thus decreased, that is, the rotational speed lower than the rotational speed V0. At this moment, when the rational speed of the fixing roller 64 reaches the lower limit, the rational speed of the fixing roller 64 is maintained at the lower limit.

As a result, when the image forming apparatus 1 becomes the printing state (ST34 period) again and the sheet starts passing through the fixing device 6, the set temperature of the fixing roller 64 becomes the low set temperature according to the temperature of the pressing roller 63 thus increased. Further, the rotational speed of the fixing roller 64 is adjusted to the low rotational speed corresponding to the inter-roller temperature difference thus decreased. Accordingly, a proper quantity of heat is supplied to the sheet, thereby preventing the offset.

Further, even when the sheet passes through the fixing device 6 again and the temperature of the pressing roller 63 decreases, the set temperature of the fixing roller 64 becomes the high set temperature according to the temperature of the pressing roller 63 thus decreased. Further, the rotational speed of the fixing roller 64 is adjusted to the high rotational speed corresponding to the inter-roller temperature difference thus increased. Accordingly, a proper quantity of heat is supplied to the sheet, thereby preventing the offset.

At the timing T48, the print control unit 200 starts the transportation of the sheet and the image forming process according to the print instruction from the upper device (not shown), so that the writing sensor 8 detects the sheet thus transported.

At the timing T49, when the print control unit 200 detects that the fifth sheet reaches the fixing device 6 from the detection result of the writing sensor 8, the motor control unit 201 changes the rational speed of the fixing roller 64 to the rotational speed V0 for the fixing operation. Further, the motor control unit 201 stops the sheet supply roller.

At the timing T50, when the print control unit 200 determines that the specific period of time W is elapsed after the sheet supply roller stops, the motor control unit 201 starts the sheet supply roller to start transporting the sixth sheet. During the specific period of time W, the inter-sheets distance becomes equal to X0 (mm). When the sheet supply roller rotates at the rotational speed Vp (mm/s), the specific period of time W is given by the following equation:

$$W(s)=X0/Vp$$

At the timing T51, when the print control unit 200 detects that the fifth sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference.

At the timing T52, the motor control unit 201 stops the sheet supply roller. Further, when the print control unit 200 detects that the sixth sheet reaches the fixing device 6 from the detection result of the writing sensor 8, the motor control unit 201 changes the rational speed of the fixing roller 64 to the rotational speed V0 for the fixing operation.

At the timing T53, when the print control unit 200 detects that the sixth sheet is discharged outside the fixing device 6 from the detection result of the discharge sensor 9 and determines that the sheet is not passing through the fixing device 6, the motor control unit 201 changes the rotational speed of the fixing roller 64 according to the inter-roller temperature difference. At this moment, it is supposed that the calculated rotational speed reaches the upper limit of the rotational speed of the fixing roller 64.

Further, when the print control unit 200 determines that the specific period of time W' is elapsed after the sheet supply roller stops, the motor control unit 201 starts the sheet supply roller to start transporting the seventh sheet. During the specific period of time W', the inter-sheets distance becomes equal to X_p (mm) calculated in step S214 shown in FIG. 13. When the sheet supply roller rotates at the rotational speed Vp (mm/s), the specific period of time W' is given by the following equation:

$$W'(s)=X_p/Vp$$

At the timing T54, when the print control unit 200 detects that the seventh sheet is reaches the fixing device 6 from the detection result of the writing sensor 8, the motor control unit 201 changes the rotational speed of the fixing roller 64 to the rotational speed V0 for the fixing operation. At the timing T55, the print control unit 200 detects that the sheet is discharged outside the fixing device 6 from the detection result of the discharge sensor 9 and determines that the sheet is not passing through the fixing device 6

In the embodiment, it is configured such that the inter-sheets distance is adjusted according to the temperature of the fixing roller 64. Alternatively, the image forming apparatus 1 may be provided with an input unit for receiving an input from a user, so that the user can set and adjust the inter-sheets distance.

In this case, the input unit: may be connected to the print control unit 200. When the print control unit 200 detects that the curl prevention setting input by the user through the input unit is valid, the print control unit 200 performs the process of adjusting the inter-sheets distance. On the other hand, the print control unit 200 detects that the curl prevention setting is not valid, the print control unit 200 does not perform the process of adjusting the inter-sheets distance and maintain the inter-sheets distance prioritizing the throughput, so that only the rational speed of the fixing roller 64 and the set temperature or the fixing roller 64 are adjusted in the inter-sheet distance.

As described above, in the second embodiment, it is configured such that the inter-sheets distance is adjusted according to the temperature of the pressing roller 63. Accordingly, it is possible to prolong the period of time for supplying heat to the pressing roller 63. As a result, even when it is difficult to reduce the inter-roller temperature difference only through adjusting the rational speed of the fixing roller 64, it is possible to maintain the inter-roller temperature difference between the fixing roller 64 and the pressing roller 63 within the proper range, thereby preventing the sheet from being curled.

Further, in the second embodiment, it is configured such that the temperature of the fixing roller 64 is adjusted according to the temperature of the pressing roller 63. Accordingly, it is possible to minimize the fluctuation in heat supplied to the sheet, thereby preventing the fixing problem.

In the first embodiment and the second embodiment described above, the image forming apparatus is explained as the printer. The present invention is not limited thereto, and the image forming apparatus may be a multi function product (MFP), a facsimile, a copier, and the like.

The disclosure of Japanese Patent Application No. 2010-278388, filed on Dec. 14, 2010, is incorporated in the application by reference.

While the invention has been explained with reference to the specific embodiments of the invention, the explanation is illustrative and the invention is limited only by the appended claims.

What is claimed is:

1. An image forming apparatus comprising:

a fixing member;

a pressing member;

a heating member for heating the fixing member;

a heating control unit that controls the heating member to heat the fixing member to a first set temperature or a second set temperature that is different from the first set temperature;

a first temperature detection unit that detects a first temperature of the fixing member;

a second temperature detection unit that detects a second temperature of the pressing member;

a temperature setting unit that sets the first set temperature or the second set temperature according to the second temperature; and a rotational speed control unit that controls a rotational speed of the fixing member according to a first temperature difference between the first temperature and the second temperature after the temperature setting unit sets the first set temperature or the second set temperature, wherein said rotational speed control unit is configured to increase the rotational speed of the fixing member when the first temperature difference increases, said heating control unit controls the heating member to heat the fixing member during a period of time in which an image is fixed to a print medium, and said rotational speed control unit is configured to control the rotational speed of the fixing member to be Vmot obtained by the following equation:

$$Vmot=V0+B\times(\Delta T-\beta)$$

where ΔT is the first temperature difference; V0 is the rotational speed of the fixing member upon fixing; β is a second temperature difference between the fixing member and the pressing member when the print medium is prevented from being curled at the rotational speed V0; B is a coefficient representing a relationship between the rotational speed and a temperature difference between the fixing member and the pressing member necessary to change the temperature difference from a current temperature difference to the second temperature difference β when a leading edge of the print medium reaches the fixing member.

2. The image forming apparatus according to claim 1, wherein said rotational speed control unit is configured to control the rotational speed of the fixing member when the fixing member rotates and the print medium is not passing through the fixing member.

3. The image forming apparatus according to claim 1, further comprising a temperature determining unit for determining a surface temperature of the fixing member from the first temperature and a surface temperature of the pressing member from the second temperature.

4. The image forming apparatus according to claim 1, wherein said rotational speed control unit is configured to control the rotational speed of the fixing member when the print medium does not pass through the fixing member.

5. The image forming apparatus according to claim 1, wherein said temperature setting unit is configured to decrease the first set temperature or the second set temperature when the second temperature increases.

6. The image forming apparatus according to claim 1, wherein said heating control unit is configured to control the heating member and said rotational speed control unit is configured to control the rotational speed of the fixing member so that a difference between the first temperature and the second temperature becomes less than a specific level.

7. The image forming apparatus according to claim 1, wherein said heating control unit is configured to control the heating member to heat the fixing member at a temperature lower than a limit temperature that is higher than the first set temperature.

8. The image forming apparatus according to claim 1, wherein said heating control unit is configured to control the heating member to heat the fixing member at a temperature lower than a hot offset generation temperature that is higher than the first set temperature.

9. An image forming apparatus comprising:

a fixing member;

a pressing member;

a heating member for heating the fixing member;

a heating control unit that controls the heating member to heat the fixing member to a first set temperature or a second set temperature that is different from the first set temperature;

a first temperature detection unit that detects a first temperature of the fixing member;

a second temperature detection unit that detects a second temperature of the pressing member;

a temperature setting unit that sets the first set temperature or the second set temperature according to the second temperature;

a rotational seed control unit that controls a rotational speed of the fixing member according to a first temperature difference between the first temperature and the second temperature after the temperature setting unit sets the first set temperature or the second set temperature; and a medium transportation unit for transporting the print medium and a medium transportation control unit that controls the medium transportation unit, wherein said rotational seed control unit is configured to increase the rotational speed of the fixing member when the first temperature difference increases, said heating control unit controls the heating member to heat the fixing member during a period of time in which an image is fixed to a print medium, and said medium transportation control unit is configured to control the medium transportation unit so that the transportation interval of the print medium is controlled to be X p obtained by the following equation:

$$Xp\ (\mathrm{mm}) = C \times (\gamma - Tlw) + X0$$

where C represents a proportional constant for calculating an optimal inter-sheets distance; γ represents a lower limit temperature of the pressing member at which the difference can be maintained within a specific range; Tlw is the second temperature; and X0 represents a minimum transportation interval of the print medium at which the print medium can be prevented from being curled.

10. The image forming apparatus according to claim 9, wherein said medium transportation control unit is configured to control the medium transportation unit according to the first temperature and the second temperature.

11. The image forming apparatus according to claim 9, wherein said medium transportation control unit is configured to control the medium transportation unit so that a transportation interval of the print medium is controlled according to the first temperature and the second temperature.

12. The image forming apparatus according to claim 9, wherein said medium transportation control unit is configured to control the medium transportation unit so that a transportation interval of the print medium is controlled according to a difference between the first temperature and the second temperature.

13. The image forming apparatus according to claim 12, wherein said medium transportation control unit is configured to control the medium transportation unit so that the transportation interval of the print medium increases when the difference increases.

14. The image forming apparatus according to claim 9, wherein said medium transportation control unit is configured to control the medium transportation unit when the fixing member rotates at a maximum rotational speed.

* * * * *